US010793994B2

(12) United States Patent
Hong et al.

(10) Patent No.: US 10,793,994 B2
(45) Date of Patent: Oct. 6, 2020

(54) CLOTHES TREATMENT APPARATUS

(71) Applicant: LG ELECTRONICS INC., Seoul (KR)

(72) Inventors: Sogkie Hong, Seoul (KR); Cheolsoo Ko, Seoul (KR); Hyeongjoong Kim, Seoul (KR); Hyojun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 198 days.

(21) Appl. No.: 15/647,387

(22) Filed: Jul. 12, 2017

(65) Prior Publication Data

US 2018/0030644 A1 Feb. 1, 2018

(30) Foreign Application Priority Data

Aug. 1, 2016 (KR) ..... 10-2016-0098206

(51) Int. Cl.

| | |
|---|---|
| ***D06F 58/24*** | (2006.01) |
| ***D06F 58/20*** | (2006.01) |
| ***D06F 18/00*** | (2006.01) |
| ***D06F 39/04*** | (2006.01) |
| ***D06F 58/02*** | (2006.01) |

(52) U.S. Cl.

CPC ..... *D06F 58/206* (2013.01); *D06F 18/00* (2013.01); *D06F 39/04* (2013.01); *D06F 58/02* (2013.01); *D06F 58/24* (2013.01)

(58) Field of Classification Search

CPC ..... D06F 58/24; D06F 58/206; D06F 58/02; D06F 59/02; D06F 39/12; D06F 37/26; D06F 39/00; D06F 58/10

See application file for complete search history.

(56) References Cited

U.S. PATENT DOCUMENTS

| | | | | |
|---|---|---|---|---|
| 9,249,538 | B2 * | 2/2016 | Bison | D06F 58/24 |
| 9,976,249 | B2 * | 5/2018 | Lv | F28F 9/001 |
| 2010/0107703 | A1 * | 5/2010 | Hisano | D06F 25/00 68/20 |
| 2014/0041400 | A1 | 2/2014 | Cavaretta | |
| 2014/0109426 | A1 | 4/2014 | Ahn et al. | |

(Continued)

FOREIGN PATENT DOCUMENTS

| | | |
|---|---|---|
| CN | 1389702 | 1/2003 |
| CN | 1540166 A | 10/2004 |

(Continued)

OTHER PUBLICATIONS

PCT International Search Report dated Sep. 20, 2017 issued in Application No. PCT/KR2017/005278.

(Continued)

*Primary Examiner* — Gregory A Wilson
(74) *Attorney, Agent, or Firm* — KED & Associates LLP

(57) ABSTRACT

A clothes treatment apparatus, including a drum rotatably provided within a cabinet to accommodate washing and drying objects; and a heat pump including an evaporator, a compressor, a condenser, and an expansion valve, through which refrigerant is circulated, to provide heat to air discharged from the drum and circulated to the drum, wherein the heat pump further includes an internal heat exchanger configured to exchange heat between refrigerant discharged from the condenser and refrigerant passing through the evaporator.

11 Claims, 18 Drawing Sheets

(56) References Cited

U.S. PATENT DOCUMENTS

| | | | | |
|---|---|---|---|---|
| 2015/0259847 | A1* | 9/2015 | Kohavi | F16L 53/00 34/468 |
| 2016/0115641 | A1* | 4/2016 | Kim | D06F 58/206 34/132 |
| 2016/0153135 | A1* | 6/2016 | Ryoo | D06F 58/206 34/108 |

FOREIGN PATENT DOCUMENTS

| | | |
|---|---|---|
| CN | 105544143 | 5/2016 |
| EP | 2 385 169 | 11/2011 |
| EP | 2 407 587 | 1/2012 |
| JP | H09-287853 | 11/1997 |
| JP | 2006-250435 | 9/2006 |
| JP | 2006-345968 | 12/2006 |
| JP | 2008-086693 | 4/2008 |
| JP | 4561488 | 10/2010 |
| JP | 2011-024659 | 2/2011 |
| JP | 4888025 | 2/2012 |
| JP | 2015-084996 | 5/2015 |
| KR | 10-2014-0050982 | 4/2014 |
| KR | 10-2016-0049734 | 5/2016 |
| WO | WO 2005/031231 | 4/2005 |

OTHER PUBLICATIONS

European Search Report dated Nov. 3, 2017 issued in Application No. 17183521.8.

Chinese Office Action (with English translation) dated May 22, 2019 issued in CN Application No. 201710646744.4.

Chinese Office Action dated Jan. 19, 2020 issued in Application 201710646744.4.

Korean Office Action dated Jun. 9, 2017 issued in Application No. KR10-2016-0098206.

Chinese Office Action dated Jul. 27, 2020 issued in Application 20170646744.4 and English translation.

* cited by examiner

CLOTHES TREATMENT APPARATUS

CROSS-REFERENCE TO RELATED APPLICATION(S)

Pursuant to 35 U.S.C. § 119(a), this application claims the benefit of earlier filing date and right of priority to Korean Application No. 10-2016-0098206, filed on Aug. 1, 2016, the contents of which is incorporated by reference herein in its entirety.

BACKGROUND

1. Field

The present disclosure relates to a clothes treatment apparatus having a heat pump system.

2. Background

A clothes treatment apparatus commonly refers to a washer that performs a function of washing clothes, a dryer that performs a function of drying clothes that have completed washing or a combination washer and dryer that performs both washing and drying functions. The clothes treatment apparatus including a drying function includes a hot air supply unit to supply hot air to objects to be dried which are put into a clothes accommodation portion. The hot air supply unit may be classified into a gas heater, an electric heater, or a heat pump system depending on the type of heat source provided to air.

The heat pump system includes a compressor, a condenser, an expansion valve, and an evaporator. High-temperature and high-pressure refrigerant compressed in the compressor circulates through a condenser, an expansion valve, an evaporator, and a compressor.

Air discharged from a drum, which is a clothes accommodation portion, is cooled and dehumidified through heat exchange with the refrigerant of the evaporator, and then heated by heat exchange with the refrigerant of the condenser. High-temperature and dry air due to the dehumidifying and heating is supplied to the drum.

An inside of the evaporator has low-pressure saturated refrigerant in which liquid refrigerant and gas refrigerant are mixed. The liquid refrigerant immediately after passing through the expansion valve is approximately 90% or more of liquid refrigerant, and the liquid refrigerant undergoes heat exchange with air discharged from the drum while passing through the evaporator, and absorbs heat from the air to evaporate and change into gas refrigerant. In theory, refrigerant should be completely in a gas phase between an outlet of the evaporator and an inlet of the compressor, and thus the compressor should not have any problem compressing the refrigerant in a gas phase.

However, when there is a sudden indoor load change such as a sudden temperature change in the drum, there may exist some refrigerant in a liquid phase in the refrigerant that has passed through the evaporator. Since this liquid-phase refrigerant is an incompressible fluid, a compressor configured to compress only compressible fluid (gas) when the liquid-phase refrigerant enters the compressor is at risk of being damaged when compressing the incompressible liquid refrigerant.

In order to prevent this, a temperature of refrigerant that has passed through the evaporator is increased by about 5° C. in the process of going to the compressor not to allow liquid refrigerant to exist as a superheated refrigerant. If a saturation temperature in the evaporator is 7° C., then a temperature of superheated refrigerant entering the compressor should be about 12° C., and a temperature difference of 5° C. is a degree of superheat. In other words, a degree of superheat (ΔTs) may be defined as follows.

$$\Delta Ts = T2 - T1$$

T1 is a saturation temperature of saturated refrigerant in the evaporator, and T2 is a temperature of superheated refrigerant entering the compressor. The superheat of refrigerant should be carried out at a rear end (outlet side) of the evaporator or in the process of going from the evaporator to the compressor.

If the degree of superheat is higher than a predetermined value, then saturated refrigerant is not completely filled up to an end of the evaporator, and the refrigerant overheats from an inside of the evaporator. The latter portion of the evaporator is filled with the superheated refrigerant, but this portion is unable to perform the role of the evaporator, and thus the dehumidifying ability of the evaporator drops.

Furthermore, for example, if the degree of superheat is 10° C., then a volume of gas refrigerant is increased as compared to the case of 5° C., and thus an amount of refrigerant circulated by the compressor is relatively reduced to reduce an amount of work done by the compressor. Moreover, the compressor is operated at a higher temperature, and thus a motor efficiency of the compressor is also decreased. Therefore, it is important that the degree of superheat is adjusted to an appropriate value.

On the other hand, the refrigerant of the condenser is cooled and condensed as it exchanges heat with air that has passed through the evaporator. The temperature at which gas-phase refrigerant introduced into the condenser becomes liquid-phase refrigerant is referred to as a saturated condensation temperature. For example, if the saturated condensation temperature of refrigerant is 51° C., then a temperature of liquid-phase refrigerant condensed in the condenser that is lower than 51° C. to become about 46° C. is referred to as supercooling.

If saturated refrigerant that has not been supercooled is directly sent to the expansion valve, part of the liquid refrigerant evaporates as a result of the resistance of the pipe to be in a gas phase (flash gas), and when mixed refrigerant in which gas refrigerant and liquid refrigerant are mixed flows into the expansion valve, a normal operation of the expansion valve is hindered due to gas refrigerant. In other words, the expansion valve performs the role of depressurizing high-temperature high-pressure liquid refrigerant to low-temperature low-pressure refrigerant, which is easy to evaporate, by a throttling action (decreasing a pressure without exchanging an amount of heat or work done with the outside), and when liquid refrigerant flows into the expansion valve together with gas refrigerant, a flow rate of liquid refrigerant may be reduced due to the obstruction of gas refrigerant having a relatively large volume when liquid refrigerant having a small volume passes through a narrow flow path of the expansion valve. Therefore, a degree of supercooling of about 5° C. should be maintained in order to prevent the generation of flash gas.

FIG. 24 is a graph showing a change in Hz (frequency) of the compressor and an opening degree of the expansion valve as drying is carried out in a heat pump clothes treatment apparatus in the related art. When applying an inverter compressor to a heat pump clothes treatment apparatus in the related art, a frequency (Hz) of an inverter compressor is increased from the start of drying to provide an amount of heat required to heat air.

However, when a refrigerant temperature of the condenser is increased beyond a predetermined value due to premature superheat during the drying cycle, it is required to control a frequency of the compressor to be reduced in advance to reduce the refrigerant temperature of the condenser to a predetermined value. Accordingly, when the frequency (Hz) of the compressor is reduced in advance, a refrigerant discharge amount of the compressor is reduced, and a temperature of air supplied to the drum is reduced due to a decrease in the heat dissipation of the condenser, thereby increasing drying time. Furthermore, when the heat dissipation of the condenser is reduced to increase a size of the condenser, there is a problem of increasing the fabrication cost of the condenser.

Furthermore, according to the related art, an auxiliary condenser is installed at a rear end of the condenser in order to enhance a degree of supercooling of the condenser. The auxiliary condenser performs the role of discharging heat emitted from the condenser to the outside. However, since the auxiliary condenser discharges the heat of the condenser to the outside, there is a problem that loss occurs from the viewpoint of energy.

In the case of a heat pump clothes treatment apparatus according to the related art, heat that can be absorbed from air discharged from the drum may be reduced, namely, a degree of superheat may be reduced as it goes to the later stage of the drying cycle. This is required to reduce an opening degree (open degree) of the expansion valve to secure adequate superheat. In other words, in the related art, the expansion valve is controlled in such a direction that an opening degree of the expansion valve decreases as the drying cycle is carried out toward the later stage. However, when an opening degree of the expansion valve is reduced, an amount of refrigerant flowing into the evaporator is reduced to decrease a flow rate of circulating refrigerant is reduced, thereby decreasing the capacity (or capability) of the heat pump cycle.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a clothes treatment apparatus associated with the present disclosure will be described in more detail with reference to the accompanying drawings. Incidentally, unless clearly used otherwise, expressions in the singular number include a plural meaning. In describing the embodiments disclosed herein, moreover, the detailed description will be omitted when a specific description for publicly known technologies to which the invention pertains is judged to obscure the gist of the present invention.

The clothes treatment apparatus may be understood as a concept including a washer, a washer dryer, and the like. In this embodiment, the clothes treatment apparatus may be implemented as a washer dryer.

Figure 1:
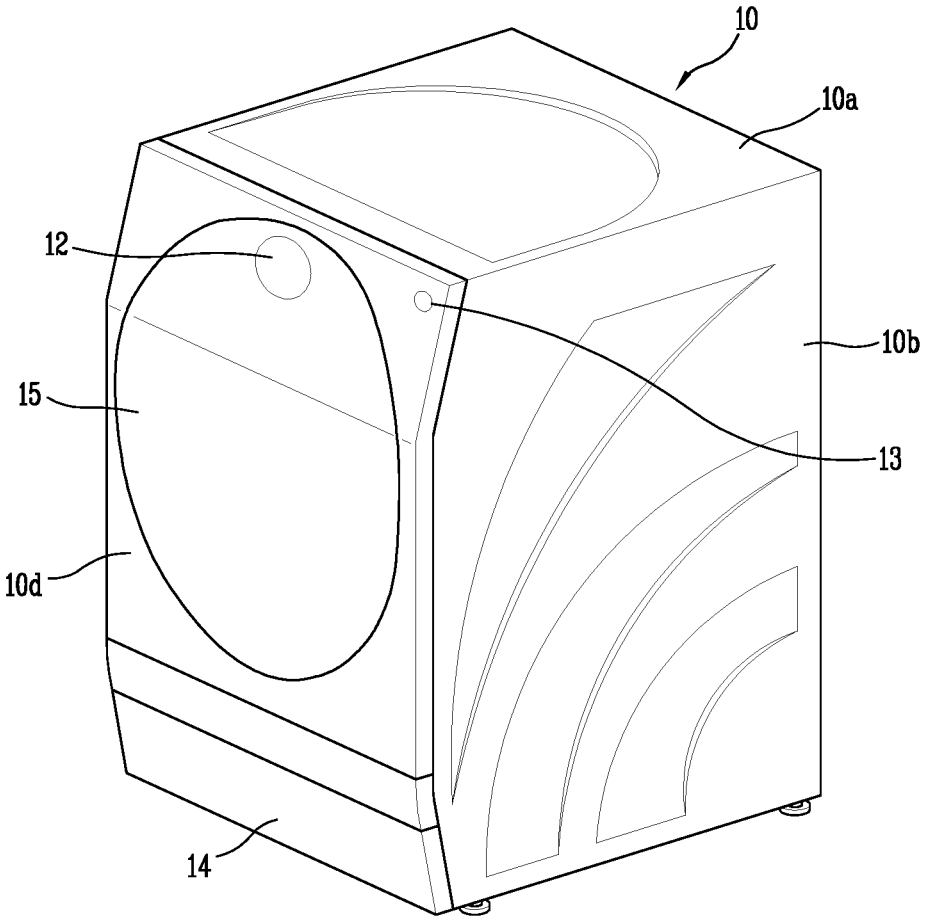
FIG. 1 is a perspective view illustrating an appearance of a clothes treatment apparatus according to an embodiment.

The clothes treatment apparatus illustrated in FIG. 1 may include a cabinet 10 that forms a body of the washer dryer. The cabinet 10 may be formed in a hexahedral shape and configured with a top cover 10*a* forming an upper surface of the washer dryer, a base cover 10*c* forming a lower surface of the washer dryer, a side cover 10*b* forming both sides of the washer dryer, a front cover 10*d* forming a front surface of the washer dryer, and a back cover 10*e* forming a rear surface of the washer dryer.

The front cover 10*d* may include an input port or opening to put objects to be washed and dried into the cabinet 10, and a circular door 11 to open and close the input port may be rotatably installed on the front cover 10*d*. A left or first end portion or side of the door 11 may be coupled to a door hinge, and a right or second end portion or side of the door 11 may be rotated in a front-rear direction around the door hinge to open and close the input port. A push-type locking device may be provided at the second side of the door 11 in such a manner that the door 11 is locked when the second side of the door 11 is pressed once, and the door 11 is unlocked when pressed again.

A touch-type display 12 for a user's manipulation may be provided at an upper end portion of the door 11 to select and change an operation mode to perform washing, dewatering and drying cycles. Furthermore, a power button 13 may be provided at an upper right end of the front cover 10*d* to turn on or off power during the washing, dewatering and drying cycles of the clothes treatment apparatus. A detergent supply unit or drawer may be installed in a drawable and insertable manner at a lower portion of the cabinet 10, and a lower cover 14 covering the detergent supply unit may be rotatably installed in an up-down direction.

Figure 2:
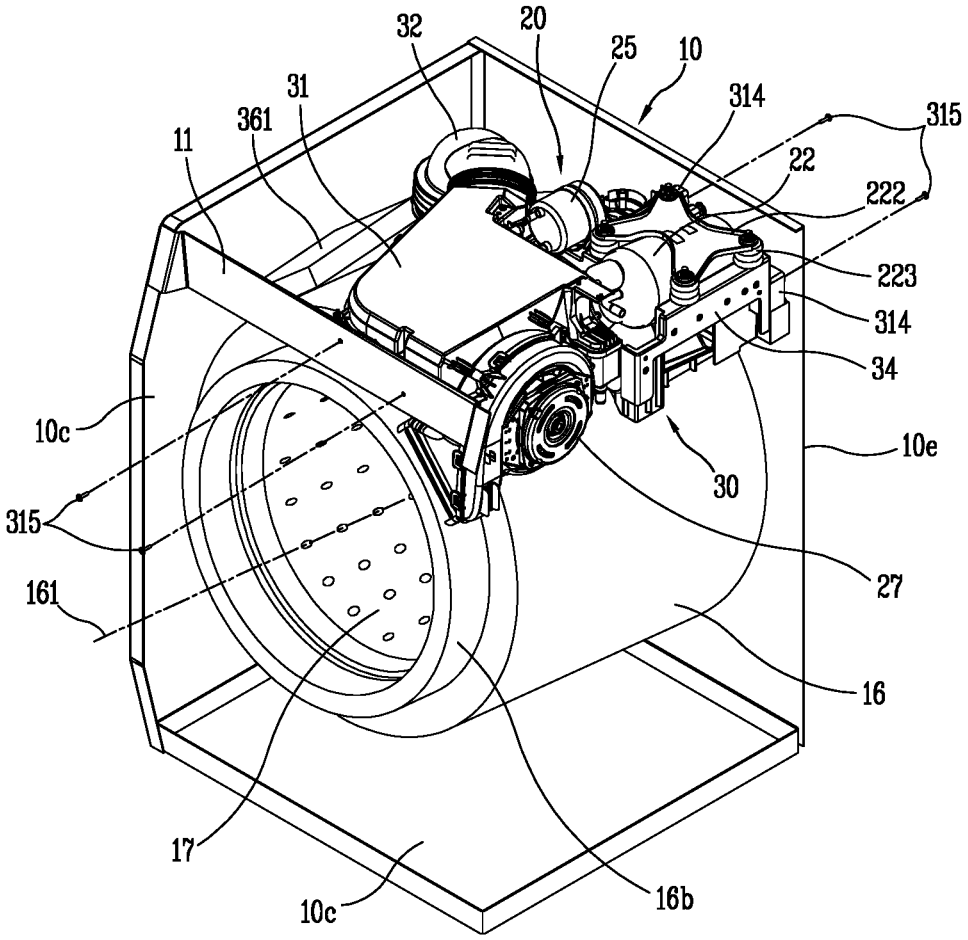
FIG. 2 is a perspective view illustrating a configuration in which a heat pump module is mounted at an inner upper portion of a cabinet in FIG. 1.

A tub 16 may be provided within the cabinet 10 illustrated in FIG. 2. The tub 16 may be formed in a cylindrical shape. A virtual center line 161 passing through the center of the tub 16 may be arranged in the front-rear direction of the cabinet 10.

The tub 16 may be inclined such that the front surface is positioned higher than the rear surface. Wash water may be stored within the tub 16. An input port or opening for putting laundry in may be formed at a front surface of the tub 16 to communicate with the input port of the cabinet 10.

A sump may be provided on a bottom surface of the tub 16. The sump may be a place where wash water is temporarily collected to discharge wash water stored in the tub 16 to an outside of the tub 16. The sump may be formed in a recessed manner such that water flowing down from the tub 16 is collected in the sump. A drain port may be formed in the sump, and wash water may be discharged to the outside through the drain port.

A gasket 16*b* may be provided at a front end portion of the tub 16. The gasket 16*b* may be formed of a rubber material or the like along a circumferential direction at the front portion of the tub 16. The gasket 16*b* may prevent wash water stored within the tub 16 from leaking into the cabinet 10.

A drum 17 may be rotatably provided within the tub 16. A front portion of the drum 17 may be open and communicably connected to the input port of the cabinet 10 and the tub 16. The drum 17 may include an accommodation space to accommodate objects to be washed and dried therein.

A drive unit or drive such as a motor or the like may be installed on a rear surface of the tub 16. A rear portion of the drum 17 may be connected to the drive unit through a rotating shaft. The drum 17 may receive power from the drive unit to rotate.

A plurality of through holes may be formed on a circumferential surface of the drum 17 to introduce water or air from the tub 16 into the drum 17 or discharge water or air from the drum 17 to the tub 16 through the through holes. A plurality of lifters may be provided on an inner circumferential surface of the drum 17 to be spaced apart in a circumferential direction. The lifter may rotate together with the drum 17 to rotate objects to be washed and dried that are accommodated in the drum 17. At this time, the objects to be washed and dried may be tumbled by being dropped by gravity in the drum 17.

A heat pump module (or heat pump) 20 may be mounted at or on an upper portion of the tub 16. The heat pump module 20 may include an evaporator 21, a condenser 23, a compressor 22, an expansion valve 24, a gas-liquid separator 25, and a suction fan 27, and an integrated housing 30 assembling them into one module. The integrated housing 30 may include a heat exchange duct portion (or heat exchange duct) 31 accommodating the evaporator 21 and the condenser 23 therein, a compressor base portion (or compressor base) 34 mounted with the compressor 22, and a gas-liquid separator mounting portion (or mount) 35 mounted with the gas-liquid separator 25. The evaporator 21, the gas-liquid separator 25, the compressor 22, the condenser 23, and the expansion valve 24 may be mounted on the integrated housing 30 to modularize the heat pump system into a single assembly.

The reason why the heat pump module 20 may be provided at an upper portion of the tub 16 is to protect the heat pump module 20 from the leakage of water when wash water is supplied to an inside of the tub 16 in the case of a washer, since water flows downward due to gravity, and thus there is a risk of leaking into a lower portion of the tub due to a sealing problem. Furthermore, when the heat pump module 20 is installed or disassembled for maintenance, the operator does not need to bend his or her back much, and thus locating the heat pump module 20 at an upper portion of the tub 16 may be more advantageous than locating at a lower portion of the tub 16.

For the heat pump module 20 of the present embodiment, the compressor 22, the expansion valve 24, the gas-liquid separator 25, and the suction fan 27, together with a heat exchanger 110 of the evaporator 21 and the condenser 23, may be integrally mounted on the integrated housing 30, thereby simplifying the structure of the heat pump system and compactly optimizing the arrangement space of the heat pump system. As a result, for the heat pump module 20 of the present embodiment, the compressor 22, together with the heat exchanger 110, may be provided in the integrated housing 30 located at an upper portion of the tub 16 to simplify the structure of a pipe connecting the compressor 22 and reduce the length of the pipe. In addition, as the heat pump system is modularized, it may be easy to assemble and install, and it may be possible to evaluate the performance of the heat pump module 20 itself prior to assembling the finished product.

The heat exchange duct portion 31, the compressor base portion 34, and the gas-liquid separator mounting portion 35 may be formed of a single body. For example, the heat exchange duct portion 31, the compressor base portion 34, and the gas-liquid separator 25 may be integrally injection-molded.

The heat exchange duct portion 31 may be provided at a front side of an upper portion of the tub 16, and the compressor base portion 34 may be provided at a rear side of an upper portion of the tub 16. A first side of the heat exchange duct portion 31 (for example, a left rear end portion with respect to a front surface of the cabinet 10) may be communicably connected to an air outlet 16*a* at an upper rear side of the tub 16 to be discharged from the drum 17 to introduce air into an inside of the heat exchange duct portion 31. A second side of the heat exchange duct portion 31 (for example, a right front end portion with respect to a front surface of the cabinet 10) may be communicably connected to an air inlet of the gasket 16*b* of the tub 16 to resupply and circulate heated air that is heat-exchanged in the heat exchange duct portion 31 again into the drum 17.

The suction fan 27 may be mounted at a right side of the heat exchange duct portion 31 with respect to a front surface of the cabinet 10. The suction fan 27 may provide circulating power to air discharged from the drum 17 such that the air discharged from the drum 17 passes through the evaporator 21 and the condenser 23 and then circulates back to the drum 17.

The integrated housing 30 may further include a gas-liquid separator mounting portion 35 at a rear side of the heat exchange duct portion 31 and a first or left side surface of the compressor base portion 34 with respect to a front surface of the cabinet 10. The gas-liquid separator mounting portion 35 may cover a lower portion of the gas-liquid separator 25. The gas-liquid separator 25 may be fixed in a state of being mounted on the gas-liquid separator mounting portion 35. The gas-liquid separator 25 may separate liquid refrigerant from gas refrigerant and transfer only gas-phase refrigerant to the compressor 22 when the liquid refrigerant is contained in the gas refrigerant discharged from the evaporator 21.

The heat exchange duct portion 31 may be supported on a front surface of the cabinet 10, and the compressor base 34 may be supported on a rear surface of the cabinet 10. For example, a front frame 15 may be provided at a front upper portion of the cabinet 10, and a front portion of the heat exchange duct portion 31 may be fastened and supported to the front frame 15 by screws 315. The screws 315 may be spaced apart and fastened to the front cover 10*d* in a diagonal direction.

Furthermore, the rear portion of the compressor base portion 34 may be fastened to the back cover 10*e* by screws 315 and supported. The screws 315 may be spaced apart and fastened to the back cover 10*e* in a diagonal direction. As a result, the integrated housing 30 in which the heat exchange duct portion 31 and the compressor base portion 34 are integrally formed may be mounted and firmly supported on an upper side of the cabinet 10.

A controller 191 may control the overall operation of the heat pump module 20 and the clothes treatment apparatus. The controller 191 may include a PCB case 19 having a rectangular parallelepiped shape with a height smaller than a length and a width thereof, a PCB integrated into the PCB case 19, and electric/electronic control components mounted on the PCB.

The PCB case 19 may be arranged in a diagonal direction (when seen from the front cover 10*d*) at a left side of the heat pump module 20 using a space between an upper portion of the tub 16 and a left side edge of the cabinet 10. Since a space between the upper center of the tub 16 and the left side cover 10*b* is small, the PCB case 19 may be preferably arranged in an inclined manner to face downward in a left lateral direction from a central upper portion of the cabinet 10 when seen from the front cover 10*d*. As a result, the PCB case 19 may avoid interference with other components, and the PCB case 19 may be compactly configured together with the heat pump module 20.

Figure 3:
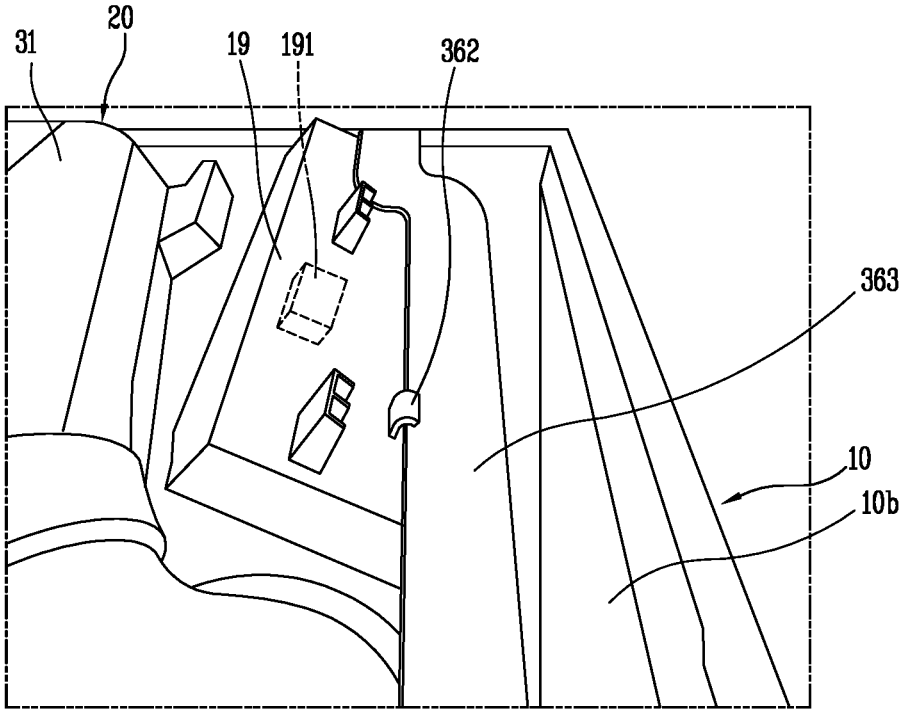
FIG. 3 is a conceptual view illustrating a configuration in which a PCB case of a controller is mounted at an upper portion of a cabinet in FIG. 2.

As illustrated in FIG. 3, the PCB case 19 may include a fixing protrusion 362 protruded from one side of an upper surface of the PCB case 19 to be stably supported within the cabinet 10. An upper end portion of the fixing protrusion 362 may be formed in a hook shape.

Furthermore, the cabinet 10 may have a fixing member 363 extended in an elongated manner from one side of an upper end of the front cover 10*d* to one side of an upper end of the back cover 10*e* to support the PCB case 19. A front end portion of the fixing member may be connected to the front cover 10*d*, and a rear end portion of the fixing member may be connected to the back cover 10*e*. Since an upper end portion of the fixing protrusion 362 is supported to engage with a side surface of the fixing member 363, the PCB case 19 may be stably supported and compactly arranged between a left side edge of the cabinet 10 and the heat pump module 20.

The PCB case 19 may be electrically connected to the heat pump module 20 to check the performance of the heat pump module 20 for each module prior to assembling the finished product of the clothes treatment apparatus. Since the PCB case 19 is connected to the heat pump module 20 to check the performance of the heat pump module 20 or the like, the PCB case 19 may be located close to the heat pump module 20. Accordingly, the PCB case 19 may be compactly installed within the cabinet 10, together with the heat pump module 20, as the PCB case 19 is arranged and connected in a diagonal direction close to a side surface of the heat pump module 20.

The heat pump module 20 may provide heat to air discharged from the drum 17. The heat exchange duct portion 31 may be connected to the tub 16 to form a circulation flow path for the circulation of air. One side of the heat exchange duct portion 31 may be connected to an upper left rear side of the tub 16 and the other side of the heat exchange duct portion 31 may be connected to an upper right front side of the tub 16.

An air outlet 16*a* may be formed at an upper left rear side of the tub 16. The air outlet 16*a* may have a shape of a circular pipe, and may be formed in a protruding manner from the tub 16 in a direct vertical direction. For example, the (a first end left rear end) of the heat exchange duct portion 31 may be connected to the tub 16 by a connecting duct 32. The connecting duct 32 may be in the form of an elbow.

One side of the connecting duct 32 may be connected to the air outlet 16*a* of the tub 16 by a bellows-shaped wrinkled pipe made of a rubber material, and the other side of the connecting duct 32 may also be connected to one side of the heat exchange duct portion 31 by a wrinkled pipe made of a rubber material. The wrinkled pipe of the connecting duct 32 may prevent vibration generated from the tub 16 from being transmitted to the heat pump module 20. For example, it may be possible to prevent vibration generated from a motor provided at a rear portion of the tub 16 from being transmitted to the heat pump module 20 through the tub 16. Conversely, it may be possible to prevent vibration generated from the heat pump module 20 from being transmitted to the tub 16.

A second end (for example, the right end portion) of the heat exchange duct portion 31 may be connected to the gasket 16*b* of the tub 16 by a fan duct portion 33. The fan duct portion 33 may include the suction fan 27 to circulate air discharged from the heat exchange duct portion 31 to the tub 16.

A first side of the fan duct portion 33 may be connected to the second side of the heat exchange duct portion 31 and a second side of the fan duct portion 33 may be communicably connected to an upper portion of the gasket 16*b* of the tub 16, and thus the fan duct portion 33 may connect the heat exchange duct portion 31 and the tub 16. The fan duct portion 33 may be connected to the gasket 16*b* made of a rubber material to prevent vibration generated from the tub 16 from being transmitted to the heat exchange duct portion 31 and the heat pump module 20. It may also be possible to prevent vibration being transmitted from the heat pump module 20 to the tub 16.

The evaporator 21 and the condenser 23 may be spaced apart from each other within the heat exchange duct portion 31. Air discharged from the air outlet 16*a* of the tub 16 may sequentially pass through the evaporator 21 and the condenser 23. The evaporator 21 may be provided at an upstream side of the condenser 23 with respect to the movement direction of air.

Figure 4:
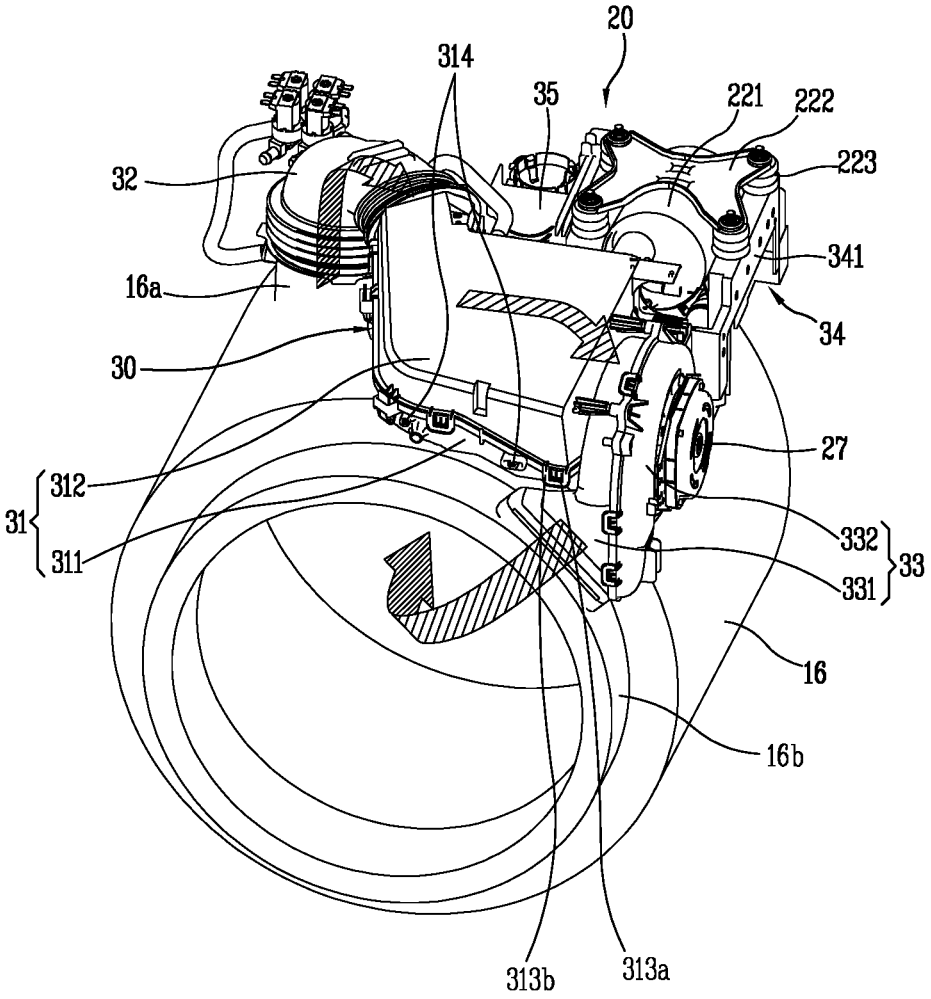
FIG. 4 is a conceptual view illustrating a configuration in which air circulates between a tub and a heat pump module in FIG. 2.

When seen from a front side of the cabinet 10 with reference to FIG. 4, air introduced into the heat exchange duct portion 31 from the air outlet 16*a* of the tub 16 through the connecting duct 32 may flow into the tub 16 through the fan duct portion 33 via the evaporator 21 and the condenser 23 in a right direction from the upper center of the tub 16 by a suction force of the suction fan 27.

The condenser 23 may be spaced apart at a right side of the evaporator 21. The condenser 23 may have a larger area than that of the evaporator 21. As the size and area of the condenser 23 increase, an amount of heat emitted through the condenser 23 may increase, and thus an amount of heat provided to air to be introduced into the tub 16 may also increase, thereby greatly contributing to the performance enhancement of the heat pump and the reduction of drying time.

To this end, an upper side of the condenser 23 may be located at the same height as that of the evaporator 21, and a lower side of the condenser 23 may be further extended downward to be located lower than the evaporator 21. Furthermore, a horizontal length of the condenser 23 in a left-right direction may be extended to be wider than that of the evaporator 21.

As a result, the upper sides of the evaporator 21 and the condenser 23, respectively, may be located on the same plane to correspond to a plane of the top cover 10*a* of the cabinet 10, and the lower sides of the evaporator 21 and the condenser 23, respectively, may be located in a stepwise manner at a portion between a long hand and a short hand at approximately 2 o'clock in an analog watch, at a predetermined interval in a right direction from the upper center along a circumferential surface of the tub 16, the evaporator 21 and the condenser 23 may be efficiently arranged using a small space above the cabinet 10.

In addition, the suction fan 27 may be provided between the condenser 23 and the cabinet 10 to efficiently use a space of the cabinet 10. A first side of the suction fan 27 may be vertical such that the first side faces the condenser 23 and a second side thereof faces a right side of the cabinet 10. When the suction fan 27 is driven, the suction fan 27 may suck air passing through the condenser 23 to blow the air to the tub 16 through the fan duct portion 33.

Figure 6:
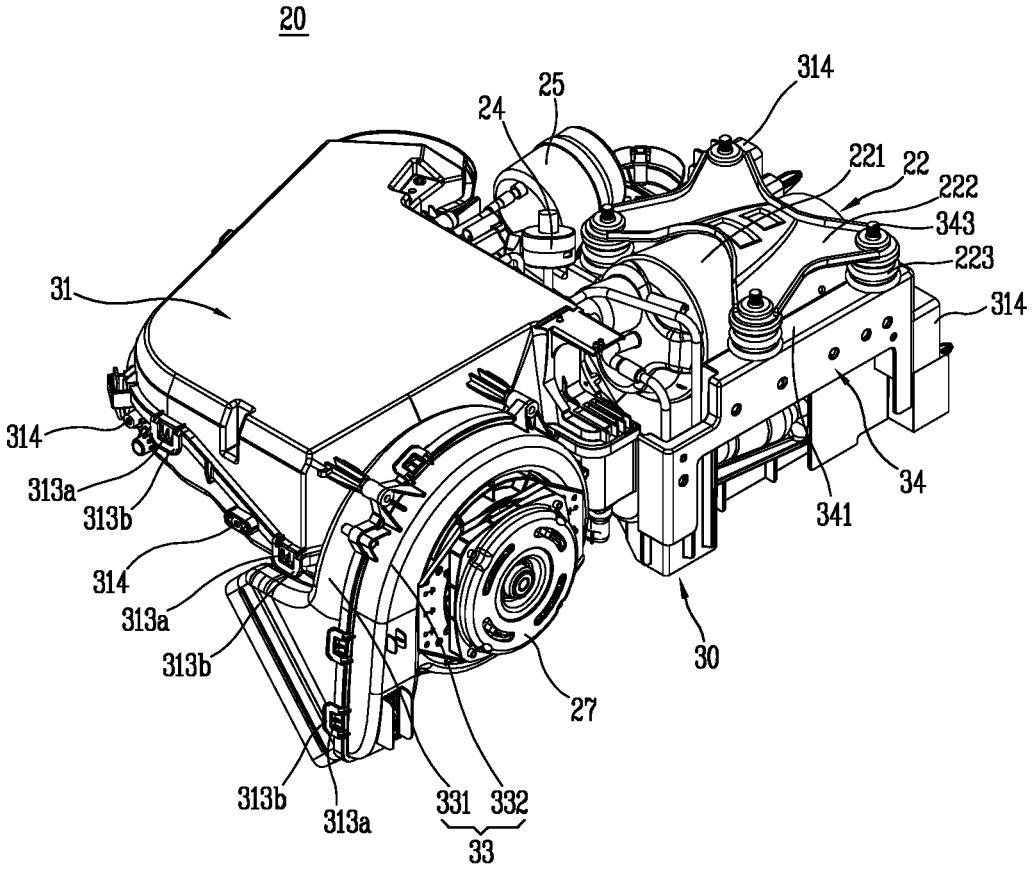
FIG. 6 is a perspective view illustrating the heat pump module in FIG. 5.
Figure 7:
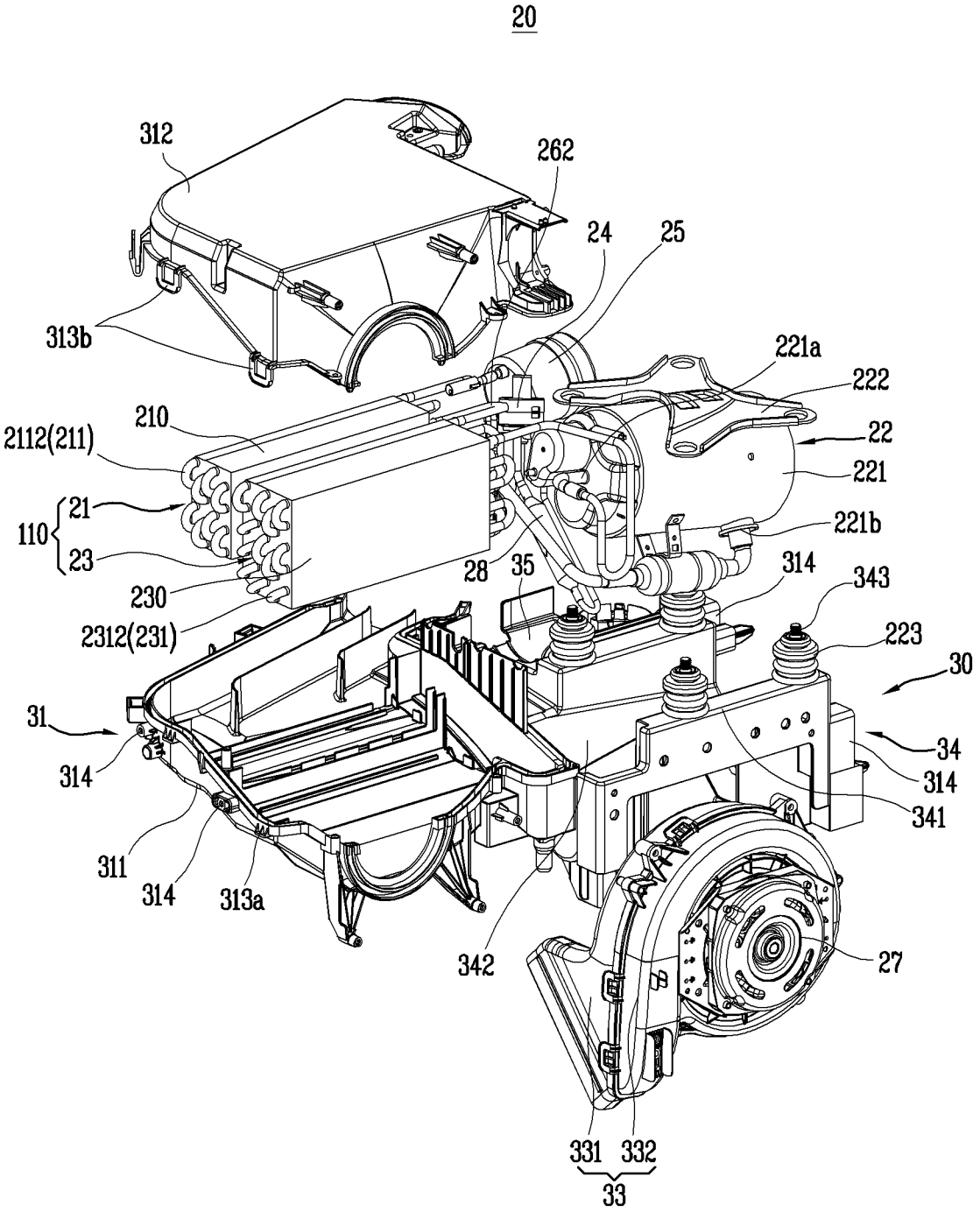
FIG. 7 is an exploded perspective view of FIG. 6.

Referring to FIGS. 6 and 7, the heat pump module 20 may be provided in an upper space in the cabinet 10, namely, a space between the top cover 10*a* and the tub 16. The heat pump module 20 may include the heat exchange duct portion 31, the fan duct portion 33, the compressor base portion 34, and the gas-liquid separator mounting portion 35.

The heat exchange duct portion 31 may be provided in a front of the cabinet 10, and the compressor base portion 34 and the gas-liquid separator mounting portion 35 may be provided in a rear of the cabinet 10. The compressor base portion 34 may be arranged behind the heat exchange duct portion 31. The heat exchange duct portion 31, the fan duct portion 33, the compressor base portion 34, and the gas-liquid separator mounting portion 35 may be integrally formed by injection molding.

The heat exchange duct portion 31 may include a base portion 311 and a cover portion 312. The base portion 311 may form a lower portion of the heat exchange duct portion 31, and the cover portion may 312 form an upper portion of the heat exchange duct portion 31. The base portion 311 and the cover portion 312 may be engaged and coupled to each other at their edge portions.

A plurality of coupling protrusions 313*a* may be formed on either one of the base portion 311 and the cover portion 312, and a plurality of protrusion receiving portions 313*b* may be formed on the other of the base portion 311 and the cover portion 312 to correspond to the plurality of coupling protrusions 313*a* such a manner that the coupling protrusions 313*a* and the protrusion receiving portions 313*b* may be coupled to each other, and thus the base portion 311 may be fastened to the cover portion 312. A plurality of fastening portions 314 may be formed in a protruding manner on the base portion 311, and the fastening portions 314 may be fastened to a front frame formed on a front upper side of the cabinet with screws 315, and thus the heat exchange duct portion 31 may be supported in front of the cabinet 10.

The fan duct portion 33 may be provided on the right side of the heat exchange duct portion 31, and the suction fan 27 may be accommodated into the fan duct portion 33. The fan duct portion 33 may include a first portion 331 formed integrally with the heat exchange duct portion 31 and a second portion 332 covering a rear surface of the suction fan 27. The first portion 331 and the second portion 332 may also be fastened to each other by the fastening members such as the coupling protrusions 313*a* and the protrusion receiving portions 313*b* described above.

The evaporator 21 and the condenser 23 may be accommodated into the heat exchange duct portion 31. The evaporator 21 may be provided upstream with respect to the movement direction of air, and the condenser 23 may be provided downstream with respect to the movement direction of air. When seen from a front side of the cabinet 10, the evaporator 21 may be spaced apart at a left side of the condenser 23. The evaporator 21 may include a refrigerant pipe 211 and a plurality of heat exchange expansion fins 210.

The plurality of heat exchange expansion fins 210 may be made of a thermally conductive material and formed in a flat plate shape. Each of the plurality of heat exchange expansion fins 210 may contact the refrigerant pipe 211 to expand a heat exchange area between refrigerant and air. The heat exchange expansion fins 210 may be spaced apart at very small intervals in a front-rear direction of the heat exchange duct portion 31. Air may pass between the heat exchange expansion fins 210 in a left and right direction of the heat exchange duct portion 31.

The refrigerant pipe 211 may be formed in a tube shape to flow refrigerant therein. The refrigerant pipe 211 may include a plurality of straight pipe portions 2111 and connection pipe portions 2112.

The plurality of straight pipe sections 2111 may extend in a front-rear direction of the heat exchange duct portion 31 and may be spaced apart from each other in an up-down direction and a left-right direction. The plurality of straight pipe sections 2111 may be brought into contact with the heat exchange expansion fins 210 to pass through the plurality of heat exchange expansion fins 210.

The plurality of connection portions may be formed in a semicircular tube shape to connect two straight pipe portions 2111 arranged adjacent to each other. The plurality of connection portions may protrude from the heat exchange expansion fins 210 to both sides in a front-rear direction of the heat exchange duct portion 31. The plurality of straight pipe portions 2111 and connection portions may be connected to a plurality of rows and a plurality of columns in the heat exchange expansion fins 210 to maximally extend a length of the refrigerant pipe 211 within the evaporator 21.

The condenser 23 may include a refrigerant pipe 231 and a heat exchange expansion fin 210. The structure of the refrigerant pipe 231 and the heat exchange expansion fin 210 in the condenser 23 may be similar to that of the evaporator 21, and thus the detailed description thereof will be omitted and differences from the evaporator 21 will be mainly described.

However, a size of the condenser 23 may be larger than that of the evaporator 21. In addition, the refrigerant of the evaporator 21 may absorb heat from air through heat exchange with the air to evaporate. The refrigerant of the condenser 23 may emit heat to air through heat exchange with the air to condense. The evaporator 21 and the condenser 23 may have opposite heat transfer directions.

The compressor body 221 may be mounted on an upper portion of the compressor base portion 34 while hanging. The compressor 22 may be a horizontal compressor 22. The horizontal compressor 22 may have a horizontally provided rotary shaft. More precisely, in the present embodiment, the horizontal compressor 22 may be inclined at an angle range of between 1 and 10 degrees with respect to a horizontal line extended in a front-rear direction of the compressor base portion 34.

A front portion of the horizontal compressor 22 may be higher than a rear portion thereof. The reason for this is that an electric mechanism unit driven by an electric motor may be provided at an inner front side of the horizontal compressor 22, and a compression mechanism unit that compresses gas refrigerant may be provided behind the electric mechanism unit to collect oil into a sliding portion of the compression mechanism unit inclined in a downward direction due to gravity so as to efficiently supply oil to the sliding portion, thereby efficiently performing a lubricating operation.

A discharge port 221*a* that discharges the compressed refrigerant may be formed at a front portion of the horizontal compressor 22. A suction port 221*b* that sucks gas refrigerant may be formed at a rear portion of the bottom surface of the horizontal compressor 22.

The compressor base portion 34 may include support fixtures 341 to support the compressor 22. The support fixtures 341 may be provided at both sides with the compressor body 221 therebetween, and spaced apart from each other in a left-right direction and extended in an up-down direction. Two anti-vibrations mounts 223 in a bellows shape may be arranged at an upper portion of each supporting fixture 341 in a front-rear direction to isolate vibration generated from the compressor 22.

A substantially X-shaped bracket 222 may be provided on an upper surface of the compressor body 221, and a central portion of the bracket 222 may be fixed to the compressor body 221 by welding at least two positions. A through hole may be formed at an edge end portion of the bracket 222 to allow a part of a bolt to pass therethrough.

Coupling holes may be formed at both sides of the support fixture 341 in a front-rear direction to allow bolts to passes therethrough. Each of the edge end portions of the bracket 222 may be fastened to an upper portion of the support fixture 341 by a fastening member 343 such as a bolt and a nut in a state that the compressor body 221 is fixed to a bottom surface of the bracket 222.

Furthermore, the compressor 22 may be located on a bottom surface of the bracket 222 while hanging from an upper portion of the support fixture 341. Both side surfaces of the compressor body 221 may be enclosed by a support fixture 341. The compressor base portion 34 may include a lower connection portion 342 connecting a lower portion of the support fixture 341. The bottom surface of the compressor body 221 may be enclosed by the lower connection portion 342.

A fastening portion 314 may be formed in a protruding manner on a rear surface of the support fixture 341 of the compressor base portion 34, and the fastening portion 314 and the back cover 10*e* of the cabinet 10 may be fastened by screws 315, and thus a rear portion of the compressor base portion 34 may be supported on a rear surface of the cabinet 10. The gas-liquid separator mounting portion 35 may be provided on a right side surface of the compressor base portion 34.

A gas-liquid separator may be mounted on the gas-liquid separator mounting portion 35. The gas-liquid separator 25 may separate gas refrigerant from liquid refrigerant when the gas refrigerant and the liquid refrigerant are mixed and discharged from the evaporator 21, and then transfer the gas refrigerant to the compressor 22.

Both side surfaces and a bottom surface of the gas-liquid separator 25 may be enclosed by the gas-liquid separator mounting portion 35. The gas-liquid separator mounting portion 35 may hold up and support the gas-liquid separator 25.

Figure 8:
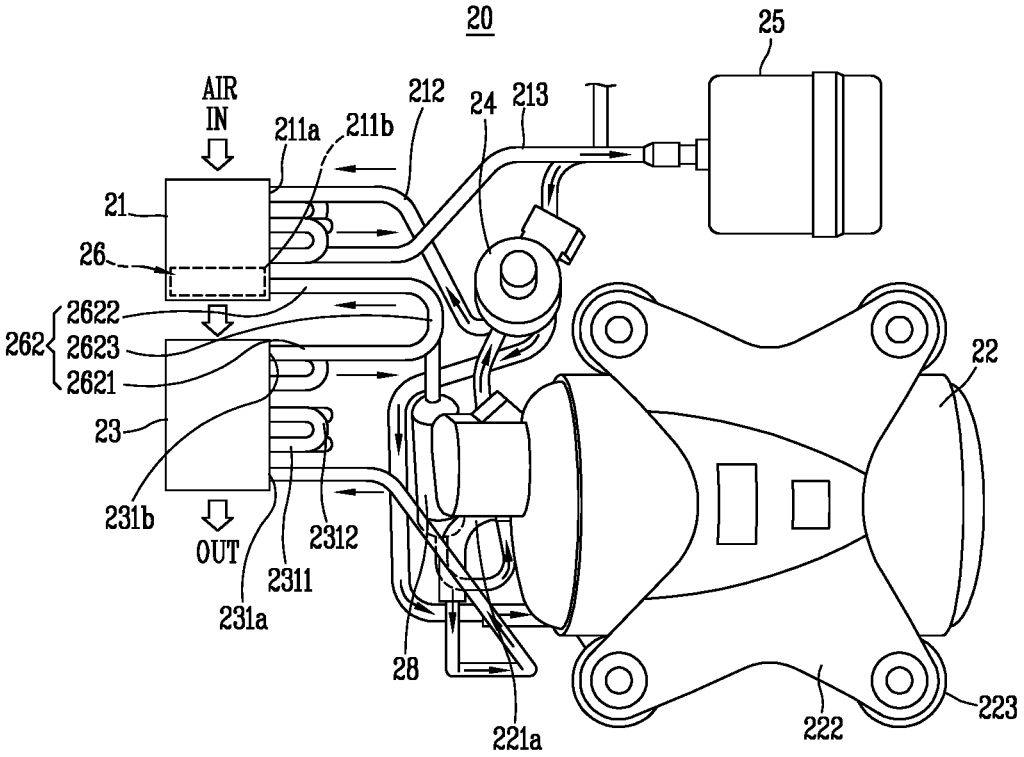
FIG. 8 is a conceptual view illustrating a configuration in which an evaporator, a condenser, an expansion valve, a gas-liquid separator, and a compressor according to a first embodiment of the present disclosure are seen from the above.

Referring to FIG. 8, the evaporator 21 and the condenser 23 may be spaced apart from each other at an upstream side and a downstream side of the heat exchange duct portion 31 with respect to the movement direction of air. FIG. 8 illustrates a configuration in which the heat exchange duct portion 31, the compressor base portion 34, and the gas-liquid separator mounting portion 35 of FIG. 6 are removed. In order to efficiently use a space between the cabinet 10 and the tub 16, the evaporator 21, the condenser 23, the compressor 22, the expansion valve 24 and the gas-liquid separator 25 spaced apart from each other may be compactly arranged.

With reference to FIG. 8, the left side surfaces of the evaporator 21 and the condenser 23 may face a front side of the cabinet 10 and the right side surfaces of the evaporator 21 and the condenser 23 may face to a rear side of the cabinet 10. The upper side surface of the evaporator may 21 face a left side cover of the cabinet 10, and a lower side surface of the condenser may 23 face a right side cover of the cabinet 10. The expansion valve 24 may face one side of the evaporator 21 (a right side surface of the evaporator 21 with reference to FIG. 8).

The compressor 22 may be provided such that the discharge port 221*a* faces one side of the condenser 23 (a right side surface of the condenser 23 with reference to FIG. 8). The suction port 221*b* of the compressor 22 may be formed at a rear side of the bottom surface of the compressor body 221, and thus is not seen in FIG. 8.

A dryer 28 may be provided between the condenser 23 and the compressor 22. The dryer 28 may be provided between a right side surface of the condenser 23 and the discharge port 221*a* of the compressor 22. The dryer 28 may remove moisture from liquid refrigerant discharged from the condenser 23. The dryer 28 may have a moisture absorbent to absorb moisture therein. The gas-liquid separator 25 may be arranged in a right diagonal direction from the expansion valve 24.

Figure 5:
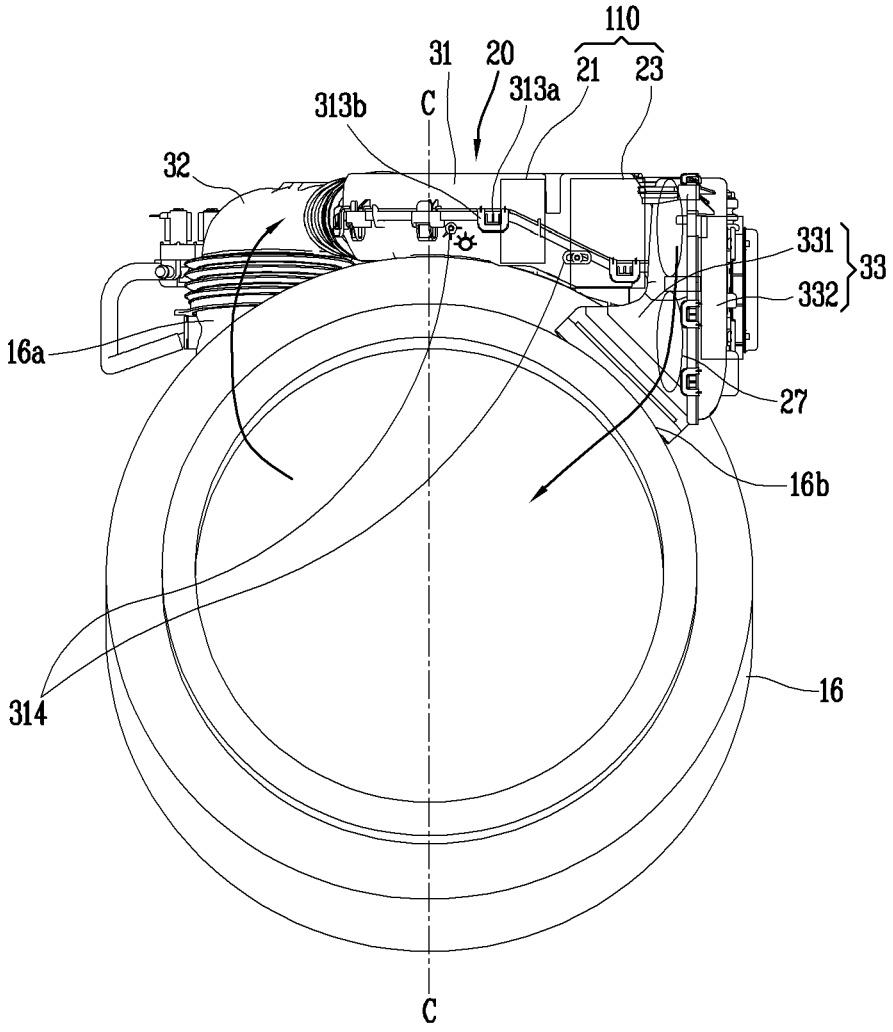
FIG. 5 is a conceptual view illustrating a configuration in which the tub and the heat pump module in FIG. 4 are seen from the front of the cabinet.
Figure 9:
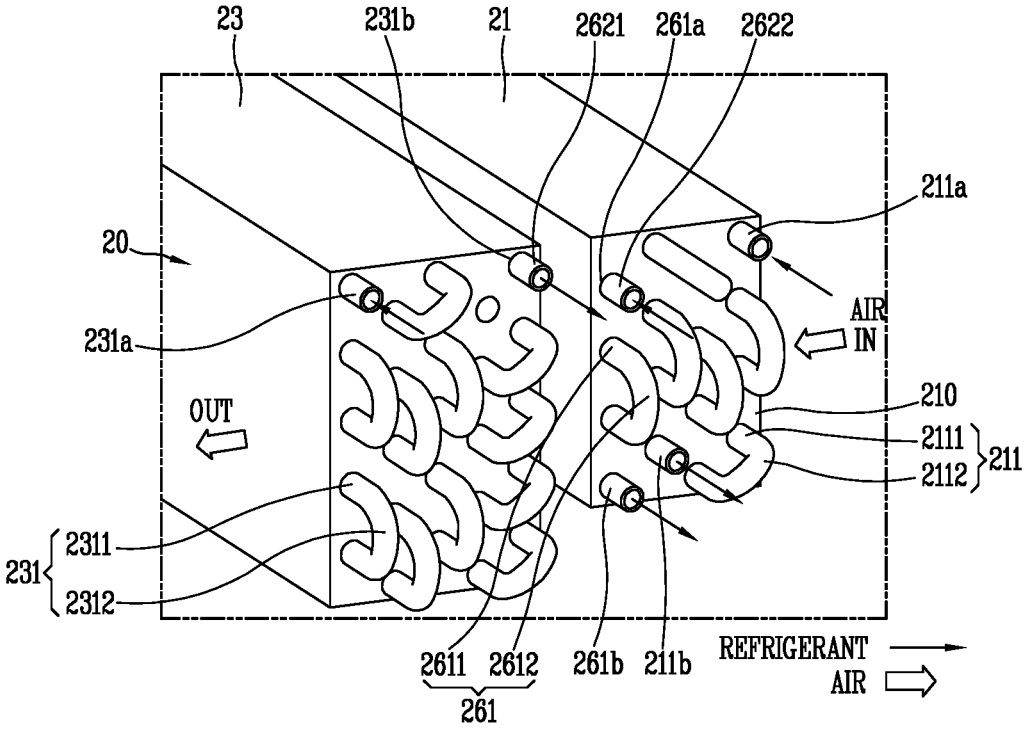
FIG. 9 is a conceptual view illustrating a configuration in which the condenser and the evaporator in FIG. 8 are seen from the rear of the cabinet in a three-dimensional view.
Figure 10:
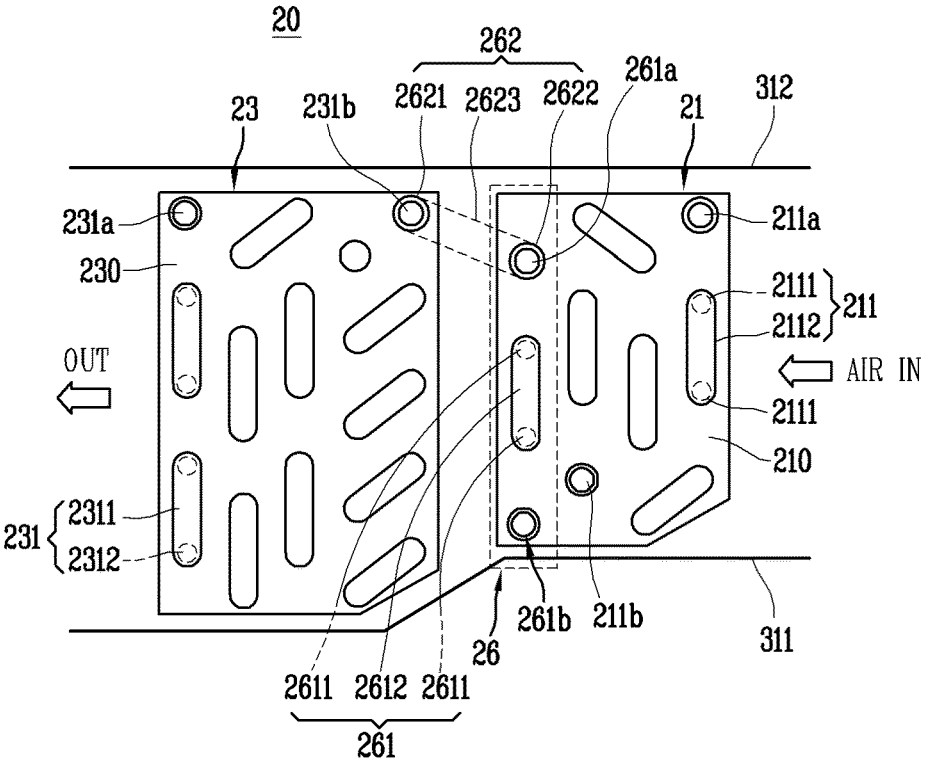
FIG. 10 is a conceptual view illustrating a configuration in which the condenser and the evaporator in FIG. 9 are seen from the rear of the cabinet in a planar (two-dimensional) view.

FIGS. 9 and 10 illustrate only the condenser 23, the evaporator 21 and the internal heat exchanger 26, and the compressor 22, a connection pipe 262 of the internal heat exchanger 26, refrigerant pipes for connecting the expansion valve 24, the gas-liquid separator 25, and the like are omitted in FIGS. 9 and 10. FIG. 9 illustrates a configuration in which the condenser 23 and the evaporator 21 are seen from the rear of the cabinet 10, and thus the positions of the evaporator 21 and the condenser 23 in FIG. 9 may be seen in reversed positions to each other with respect to the evaporator 21 and the condenser 23 in FIG. 5. In FIG. 9, air moves from the right side (upstream side) to the left side (downstream side), and the evaporator 21 and the condenser 23 may be located on the left and the right, respectively.

FIG. 10 illustrates a configuration in which the condenser 23 and the evaporator 21 are seen in the same direction as in FIG. 9, and thus the evaporator 21 is located on the right side and the condenser 23 is located on the left side. However, a portion of the heat exchange duct portion 31, namely, an upper surface of the cover portion 312 and a lower surface of the base portion 311 are additionally illustrated in FIG. 10.

The refrigerant pipe 231 of the condenser 23 illustrated in FIG. 9 may be divided into a plurality of straight pipe portions 2311 extended in a front-rear direction in the heat exchange duct portion 31 and a connection pipe portion 2312 formed in a semicircular tube shape to connect two straight pipe portions 2311 adjacent to each other. A plurality of straight pipe portions 2311 and connection pipe portions 2312 of the refrigerant pipe 231 may be connected to each other to form a single refrigerant flow path.

The straight pipe portions 2311 of the condenser 23 may be arranged in five rows by five columns. The rows denote a configuration in which the straight pipe portions 2311 are spaced apart in a vertical direction in the heat exchange expansion fins 210 of the condenser 23, and the columns denote a configuration in which the straight pipe portions 2311 are spaced apart in a horizontal direction in the heat exchange expansion fins 210 of the condenser 23.

The straight pipe portions 2311 of the condenser 23 may be provided in a first through a fifth row from the left to the right of the heat exchange expansion fin 230 of the condenser 23, and provided in a first through a fifth column from the top to the bottom of the heat exchange expansion fin 230 of the condenser 23 with reference to FIG. 10 for the sake of convenience of explanation. A first row, a third row and a fifth row may be located above a second row and a fourth row. A first through a fifth row may be alternately arranged in an up-down direction while being alternately arranged in a left-right direction in the heat exchange expansion fin 230 of the condenser 23. Furthermore, each of the first through the fifth row may be arranged on a straight line in an up-down direction.

The refrigerant inlet 231*a* of the condenser 23 may be located in a first column of a first row thereof, and the refrigerant outlet 231*b* of the condenser 23 may be located in a first column of a fifth row thereof. The refrigerant in the condenser 23 may move from the left to the right of the heat exchange expansion fin 230, and air may move from the right to the left of the heat exchange duct portion 31. The refrigerant of the condenser 23 and air passing through the condenser 23 may flow in opposite directions to more efficiently perform heat exchange.

Refrigerant flowing into the refrigerant inlet 231*a* of the condenser 23 may perform heat exchange with air passing through the condenser 23 while flowing along a refrigerant flow path such that the refrigerant dissipates heat to the air, and thus the refrigerant itself may be cooled and condensed into liquid refrigerant, and the air may be heated. The straight pipe portions 2111 of the evaporator 21 may be arranged in three rows by four columns.

The straight pipe portions 2311 of the condenser 23 may be provided in a second through a fourth row from the left to the right of the heat exchange expansion fin 210 of the evaporator 21, and provided in a first through a fourth column from the top to the bottom of the heat exchange expansion fin 210 of the evaporator 21 with reference to FIG. 10 for the sake of convenience of explanation. A second row and a fourth row may be located above a third row. A second through a fourth row may be alternately arranged in an up-down direction while being alternately arranged in a left-right direction in the heat exchange expansion fin 210 of the evaporator 21. Furthermore, each of the second through the fourth row may be arranged on a straight line in an up-down direction.

The refrigerant inlet 211*a* of the evaporator 21 may be located in a first column of a fourth row thereof, and the refrigerant outlet 211*b* of the evaporator 21 may be located in a fourth column of a second row thereof. The refrigerant in the evaporator 21 may move from the left to the right of the heat exchange expansion fin 210, and air may move from the right to the left of the heat exchange duct portion 31. The refrigerant of the evaporator 21 and air passing through the condenser 23 may flow in the same direction to perform heat exchange.

The refrigerant flowing into the refrigerant inlet 211*a* of the evaporator 21 may perform heat exchange with the air passing through the evaporator 21 while flowing along the refrigerant flow path, and the heat of the air may be transferred to the refrigerant to cool the air, and moisture contained in the air may be condensed to generate condensate water, and the refrigerant itself may absorb heat from the air to evaporate. When the refrigerant inlet 211*a* of the evaporator 21 is formed at an upper right side surface of the evaporator in FIG. 8, the first refrigerant pipe 212 extending from an outlet of the expansion valve 24 to the refrigerant inlet 211*a* of the evaporator 21 may intersect with the second refrigerant pipe 213 extended from the refrigerant outlet 211*b* of the evaporator to the inlet of the gas-liquid separator 25.

The heat pump module 20 may further include an internal heat exchanger 26. The internal heat exchanger 26 may exchange heat between refrigerant discharged from the condenser 23 and refrigerant passing through the evaporator 21. The internal heat exchanger 26 may be a fin-and-tube type heat exchanger.

The fin-and-tube type heat exchanger 26 may denote a heat exchanger 26 configured with a combination of a fin and a tube. Air may exchange heat with refrigerant while passing between fins. Refrigerant may flow through an inside of the tube to exchange heat between the air and the refrigerant. Air may be brought into contact with the fins and tubes to exchange heat with the refrigerant. However, air and refrigerant may not be mixed with each other.

The fin may be formed in a flat plate shape, and a plurality of fins may be spaced apart from each other. The fin may expand a heat exchange area between air and refrigerant.

In the present embodiment, the internal heat exchanger 26 may share the heat exchange expansion fins 210 of the evaporator 21 without having additional fins. The internal heat exchanger 26 may be provided within the evaporator 21. In this case, a separate installation space is not required.

The internal heat exchanger 26 may include an internal heat exchange pipe 261 and a connection pipe 262. The internal heat exchange pipe 261 may be provided within the evaporator 21. The internal heat exchange pipe 261 may be provided separately from the refrigerant pipe 211 of the evaporator 21. In other words, the internal heat exchange pipe 261 may be provided separately from a plurality of straight pipe portions 2111 and connection pipe portions 2112 of the evaporator 21.

The internal heat exchange pipe 261 may be provided at a downstream side within the evaporator 21. Referring to FIGS. 8-10, the downstream side within the evaporator 21 denotes that it is located on a left side of the evaporator 21 with respect to the movement direction of air.

The internal heat exchange pipe 261 may include a plurality of straight pipe portions 2611 and a plurality of connection pipe portions 2612. The straight pipe portions 2611 of the internal heat exchange pipe 261 may be arranged in a row at the downstream side of the heat exchange expansion fin 210 of the evaporator 21. There may be four straight pipe portions 2611 of the internal heat exchange pipe 261, and for the sake of convenience of explanation, they may be arranged in a first row on the left of the heat exchange expansion fins 210 of the evaporator 21, and at a first through a fourth column from the top to the bottom on the basis of FIG. 10.

A plurality of connection pipe portions 2612 may protrude from both sides of front and rear ends of the heat exchange expansion fin 210 of the evaporator 21 to connect the straight pipe portions 2611 of the internal heat exchange pipe 261.

The connection pipe 262 of the internal heat exchanger 26 may include a first and a second straight pipe portion 2621, 2622 arranged in parallel with each other, and a semicircular connection portion 2623 connecting a first and a second straight pipe portion 2621, 2622. The first straight pipe portion 2621 may extend from the refrigerant outlet 231*b* of the condenser 23 to the connection pipe portion 2623, and the second straight pipe portion 2622 may extend from the connection pipe portion 2623 to the inner heat exchanger pipe 261.

The connection pipe 262 of the internal heat exchanger 26 may extend from the refrigerant outlet 231*b* located in a first column of a fifth row in the heat exchange expansion fin 230 of the condenser 23 and the refrigerant inlet port 261*a* of the internal heat exchanger 26 located in a first column of a first row in the heat exchange expansion fin 210 of the evaporator 21 to communicably connect the refrigerant outlet 231*b* of the condenser 23 to the internal heat exchange pipe 261. Accordingly, refrigerant discharged from the condenser 23 may be introduced into the internal heat exchange pipe 261 of the internal heat exchanger 26.

The internal heat exchanger 26 may perform heat exchange between the condenser 23 and the evaporator 21 to secure superheat degree and supercooling degree. The purpose of exchanging heat between the condenser 23 and the evaporator 21 in the internal heat exchanger 26 is to secure superheat degree and supercooling degree, and a heat generating function of the condenser 23 and a dehumidifying function of the evaporator 21 are separately provided.

Figure 11:
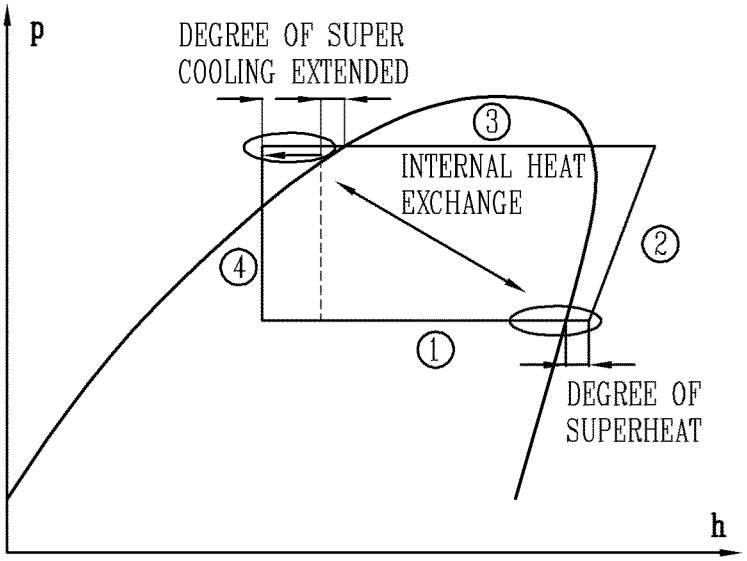
FIG. 11 is a p-h diagram illustrating a process of evaporating, compressing, condensing, and expanding refrigerant in a heat pump module according to an embodiment.

FIG. 11 is a p-h diagram illustrating a process of evaporating, compressing, condensing, and expanding refrigerant in the heat pump module 20 according to a first embodiment of the present disclosure. Refrigerant may move in the sequence of the evaporator 21, the compressor 22, the condenser 23, the expansion valve 24, and then the evaporator 21 again, and may be repeatedly circulated with the following steps as one cycle. In addition, refrigerant temperatures may be different in the following steps. Here, the temperatures of refrigerant for each step are not limited thereto.

Step ①: Evaporation (refrigerant temperatures 20~40° C.),

Step ②: Compression (refrigerant temperatures 90~100° C.),

Step ③: Condensation (refrigerant temperatures 50~80° C.),

Step ④: Expansion (refrigerant temperatures 45~75° C.)

The movement path of refrigerant and the action of refrigerant at each step will be described in more detail. Refrigerant may move to the evaporator 21 and exchange heat with air in the evaporator 21, and absorb heat from the air to evaporate into gas. The temperatures of the refrigerant within the evaporator 21 may be in a range of 20 to 40° C.

The refrigerant may be superheated at a rear end of the evaporator 21. In theory, assuming that the temperature of the refrigerant is constant within the evaporator 21, a degree of superheat may be defined as a difference between a refrigerant temperature (Teva_out) at the refrigerant outlet 211*b* of the evaporator 21 and a refrigerant temperature (Tcomp_in) at the inlet 221*b* of the compressor 22. In other words, the degree of superheat may be Tcomp_in ~Teva_out. The degree of superheat may be controlled by a washer dryer. The degree of superheat may be adjusted in a range of 3 to 7° C. The evaporator 21 may exchange heat with the condenser 23 through the internal heat exchanger 26.

The internal heat exchanger 26 may be provided at a downstream side (with respect to the movement direction of air) within the evaporator 21, and refrigerant at a rear end of the evaporator 21 may absorb heat from the refrigerant of the condenser 23 to overheat as heat exchange is carried out between the internal heat exchange pipe 261 of the internal heat exchanger 26 and the refrigerant pipe 211 of the evaporator 21. Accordingly, the evaporator 21 according to the present disclosure may absorb heat from the condenser 23, thereby securing superheat. Therefore, liquid refrigerant that has not evaporated at a rear end of the evaporator 21 may be overheated by the internal heat exchanger 26, thereby minimizing refrigerant in a liquid phase from being introduced into the compressor 22.

Refrigerant may move to the gas-liquid separator 25 from the evaporator 21 and gas refrigerant and liquid refrigerant may be separated in the gas-liquid separator 25, and then the gas refrigerant may be discharged from the gas-liquid separator 25 and moved to the compressor 22. The liquid refrigerant may be stored in a liquid refrigerant storage portion of the gas-liquid separator 25, and then a small amount of liquid refrigerant may be evaporated while leaking out of a fine hole formed in the refrigerant storage portion to facilitate evaporation and moving along a flow path.

The gas refrigerant leaking out of the gas-liquid separator 25 may move to the compressor 22, and the gas refrigerant may be compressed by the compression mechanism unit of the compressor 22. The refrigerant temperatures in the compressor 22 may be 90 to 100° C.

The refrigerant discharged from the compressor 22 may move to the condenser 23, and the refrigerant may exchange heat with air in the condenser 23 to dissipate heat to the air and then condense into liquid. The temperatures of refrigerant in the condenser 23 may be in a range of 50 to 80° C. The refrigerant discharged from the condenser 23 may move to the expansion valve 24.

The refrigerant discharged from the condenser 23 may be supercooled at a rear end of the evaporator 21 prior to flowing into the expansion valve 24. Assuming that the temperature of the refrigerant in the condenser 23 is theoretically constant, a degree of supercooling may be defined as a difference between a refrigerant temperature (Tcond_out) at the refrigerant outlet 231*b* of the condenser 23 and a refrigerant temperature (Texp_in) at the refrigerant inlet 24*a* of the expansion valve 24. In other words, the degree of supercooling may be Texp_in ~Tcond_out.

The degree of supercooling may be set according to a washer dryer. The degree of super cooling may be adjusted to 5° C. Here, the condenser 23 may exchange heat with the evaporator 21 through the internal heat exchanger 26.

As the internal heat exchanger 26 is provided at a downstream side (with respect to the movement direction of air) within the evaporator 21, and refrigerant discharged from the condenser 23 is introduced into the internal heat exchange pipe 261 of the internal heat exchanger 26 through the connection pipe 262, and heat exchange is carried out between the internal heat exchange pipe 261 and the refrigerant pipe 211 of the evaporator 21, the refrigerant of the condenser 23 may be cooled by the refrigerant of the evaporator 21 and thus supercooled. Accordingly, the condenser 23 according to the present disclosure may dissipate heat to the evaporator 21 to secure a degree of supercooling. Therefore, gas refrigerant that has not been condensed in the condenser 23 may be supercooled by the internal heat exchanger 26 to prevent the gas refrigerant from flowing into the expansion valve 24.

Next, the operation of the air movement path and the heat pump module 20 will be described. Air discharged from the tub 16 and the drum 17 may be sucked into the heat exchange duct portion 31 by the suction fan 27.

The air sucked into the heat exchange duct portion 31 may be cooled through heat exchange with the refrigerant of the evaporator 21 while passing through the evaporator 21. Moisture contained in the air passing through the evaporator 21 may be condensed to generate condensate water, and the generated condensate water may be collected through a condensate water collection unit provided at a lower portion of the evaporator 21, and then discharged to an outside of the cabinet 10 (a dehumidifying function of the evaporator 21).

Dry air from which moisture has been removed may move from the evaporator 21 to the condenser 23 to perform heat exchange between the refrigerant and air in the condenser 23, and heated by heat emitted from the refrigerant of the condenser 23 to generate hot air (a heating function of the condenser 23). The generated hot air may be supplied to objects to be dried that are accommodated in the tub 16 and the drum 17 through the fan duct portion 33 to dry the objects to be dried.

Figure 12:
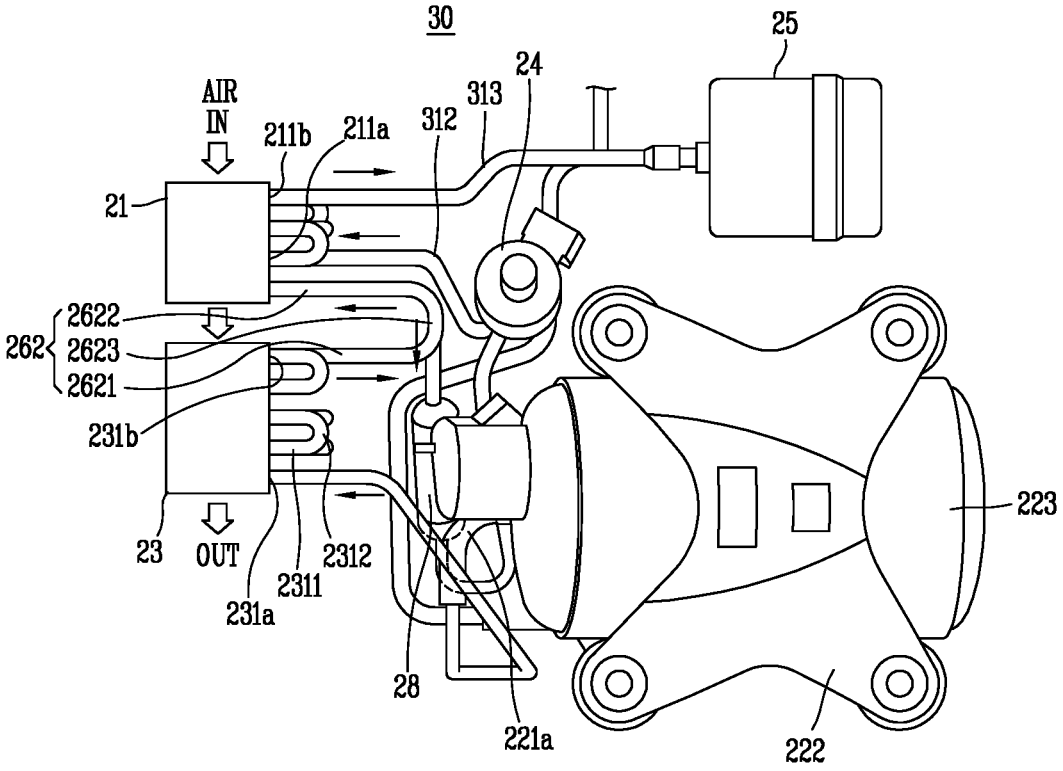
FIG. 12 is a conceptual view illustrating a configuration in which an evaporator, a condenser, an expansion valve, a gas-liquid separator, and a compressor according to an embodiment are seen from above.
Figure 13:
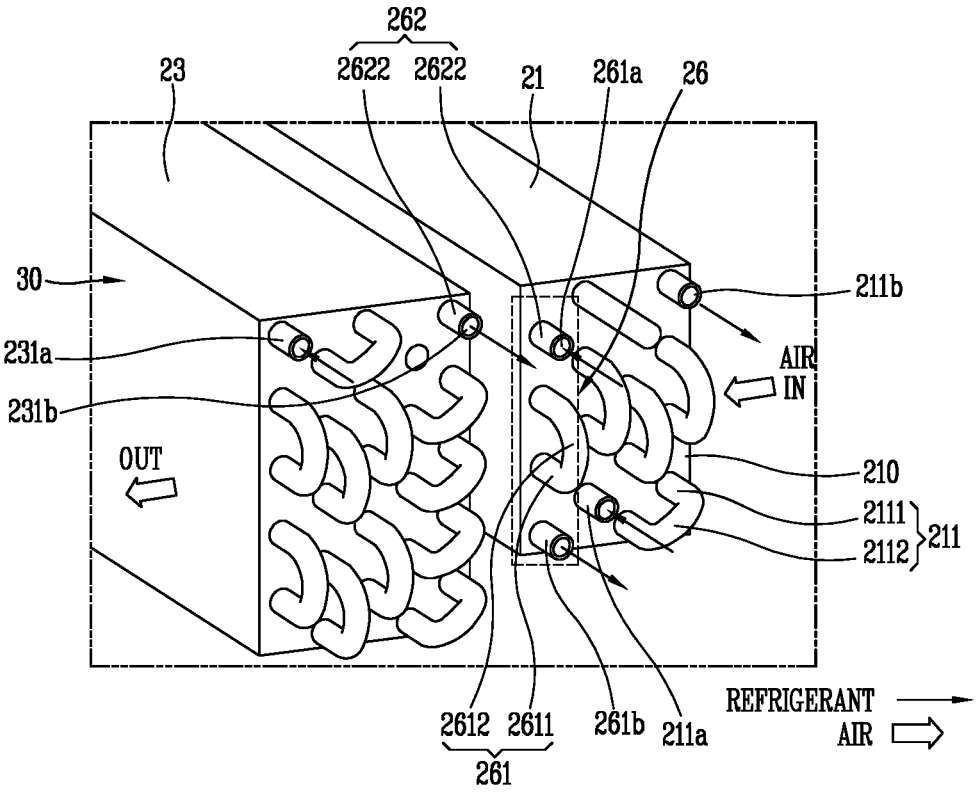
FIG. 13 is a conceptual view illustrating a configuration in which the condenser and the evaporator in FIG. 12 are seen from the rear of the cabinet in a three-dimensional view.
Figure 14:
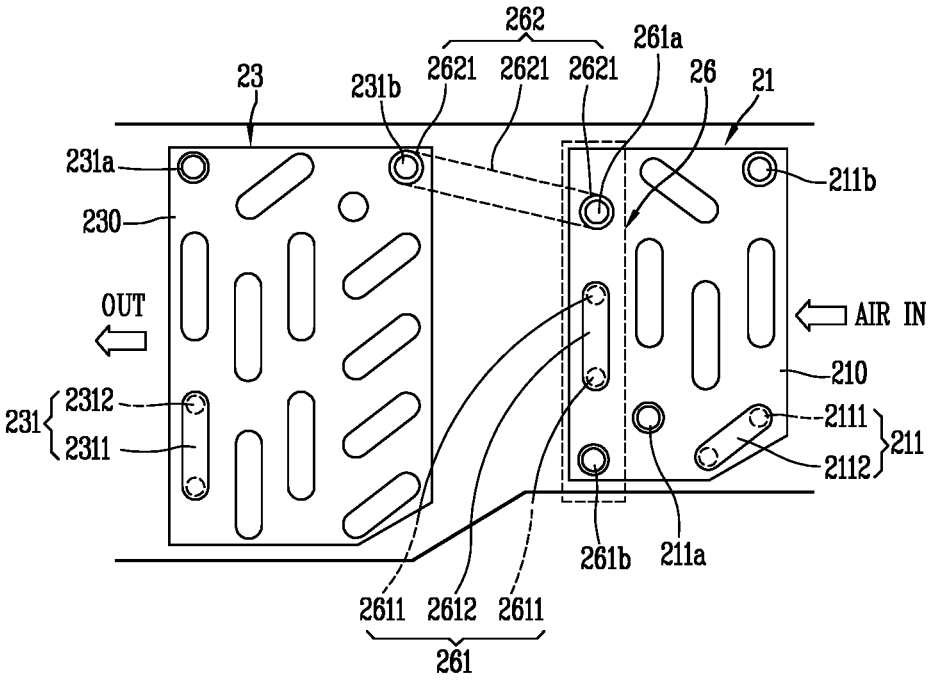
FIG. 14 is a conceptual view illustrating a configuration in which the condenser and the evaporator in FIG. 12 are seen from the rear of the cabinet in a planar (two-dimensional) view.

Referring to FIGS. 12-14, according to another embodiment, the configuration and operation effects thereof are the same or similar to those of the first embodiment except that the directions of the refrigerant inlet 211*a* and the refrigerant outlet 211*b* of the evaporator 21 are opposite to those of the first embodiment, and thus the description of other configurations according to the second embodiment will be omitted, and differences between the first embodiment and the second embodiment will be mainly described.

According to the present embodiment, the refrigerant inlet 211*a* of the evaporator 21 may be formed on a lower right side surface of the evaporator 21 (at a downstream side with respect to the movement direction of air) with reference to FIG. 12. The air may move from the upper side to the lower side. According to the present embodiment, the refrigerant outlet 211*b* of the evaporator 21 may be formed on an upper right side surface of the evaporator 21 (at an upstream side with respect to the movement direction of air) with reference to FIG. 12.

When the refrigerant outlet 211*b* of the evaporator 21 is formed on an upper right side surface of the evaporator 21, the first refrigerant pipe 312 that extends from the outlet of the expansion valve 24 to the refrigerant inlet 211*a* of the evaporator 21 may be parallel to the second refrigerant pipe 313 that extends from the refrigerant outlet 211*b* of the evaporator 21 to the inlet of the gas-liquid separator 25, and the structure of the pipe may be simpler than that of the first embodiment, and thus may have an advantage in the aspect of productivity. As illustrated in FIGS. 13 and 14, the refrigerant inlet 211*a* of the evaporator 21 may be formed at a downstream side within the evaporator 21 with respect to the movement direction of air. More specifically, the refrigerant inlet 211*a* of the evaporator 21 may be located in a fourth column of a second row in the heat exchange expansion fin 210 of the evaporator 21. The refrigerant inlet 211*a* of the evaporator 21 may be provided below the evaporator 21.

Furthermore, the refrigerant outlet 211*b* of the evaporator 21 may be formed on the upstream side in the evaporator 21 with reference to the movement direction of air. More specifically, the refrigerant outlet 211*b* of the evaporator 21 may be located in a first column of a fourth row in the heat exchange expansion fin 210 of the evaporator 21. The refrigerant outlet 211*b* of the evaporator 21 may be formed at an upper right corner of the evaporator 21.

When the refrigerant inlet 211*a* of the evaporator 21 is arranged close to the internal heat exchanger 26, an average temperature of refrigerant flowing into the evaporator 21 may rise within the evaporator 21 by heat emitted from the internal heat exchanger 26. Therefore, since a refrigerant temperature of the evaporator 21 of the second embodiment is relatively higher than that of the evaporator 21 of the first embodiment, the dehumidification performance of the evaporator 21 according to the second embodiment may be lower than that of the first embodiment from the standpoint of refrigerant.

Instead, the refrigerant of the evaporator 21 may move from the left side to the right side of the heat exchange duct portion 31, and air discharged from the tub 16 may move from the right side to the left side of the heat exchange duct portion 31 with reference to FIG. 14, and thus the flows of the refrigerant and the air in the evaporator 21 may form counter flows in opposite directions to each other, and therefore, from the standpoint of a heat exchange efficiency between refrigerant and air within the evaporator 21, the dehumidification performance of the evaporator 21 may be higher than that of the first embodiment. Therefore, considering both the standpoint of refrigerant and the standpoint of a heat exchange efficiency between refrigerant and air, an overall dehumidification performance of the evaporator 21 may not be greatly changed.

Figure 15:
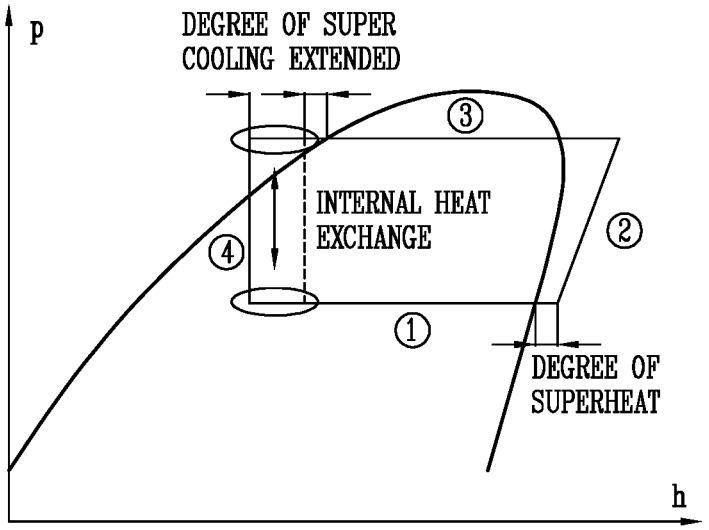
FIG. 15 is a p-h diagram for explaining a process of evaporating, compressing, condensing, and expanding refrigerant in a heat pump module according to an embodiment.

FIG. 15 is a p-h diagram explaining a process of evaporating, compressing, condensing, and expanding refrigerant in the heat pump module 30 according to a second embodiment of the present disclosure. The movement path of refrigerant and the action of refrigerant for each step in the second embodiment are similar to those in the description of FIG. 11 according to the first embodiment, and thus the detailed description thereof will be omitted.

However, the second embodiment is different from the first embodiment only in that the heat exchange of the internal heat exchanger 26 provided at a downstream side of the evaporator 21 with respect to the movement direction of air is carried out between refrigerant discharged from the condenser 23 and refrigerant flowing into the refrigerant inlet of the evaporator 21, but they are the same in securing the supercooling degree of the condenser 23 and the superheating degree of the evaporator 21. As illustrated in FIG. 16 through 23, the heat exchange expansion fin 210 of the evaporator 21 may be divided into an inner heat exchanger mounting portion 26', 36', 46', 56', 66', 76', 86', 96' and an evaporator refrigerant pipe mounting part 21'.

The straight pipe portions 2611, 3611, 4611, 5611, 7611, 8611, 9611 of a refrigerant pipe 261, 361, 461, 561, 761, 861, 961 may be mounted on the heat exchanger mounting portion 46', 56', 66', 76', 86', 96', and the straight pipe portions 2111 of a refrigerant pipe 211 of the evaporator 21 may be mounted on the evaporator refrigerant pipe mounting portion 21'. However, an arrangement of an internal heat exchanger 26, 36, 46, 56, 66, 76, 86, 96 and a ratio occupied by the internal heat exchanger 26, 36, 46, 56, 66, 76, 86, 96 within the evaporator 21 illustrated in FIGS. 16 through 23 may be different.

The internal heat exchangers 26, 36, 46, 56, 66, 76, 86, 96 illustrated in FIGS. 16 through 19 may be provided in at least two columns in one row at a downstream of the evaporator 21. In the evaporator 21 illustrated in FIG. 16, the internal heat exchanger 26 may be provided in a single row at a downstream side of the evaporator 21 with respect to the movement direction of air. More specifically, the straight pipe portions 2611 of the internal heat exchange pipe 261 may be provided disposed in a single row by four columns on a left side surface of the heat exchange expansion fin 210 of the evaporator 21. It may be the same as the arrangement structure of the internal heat exchanger 26 according to the first embodiment and the second embodiment of the present disclosure.

Figure 16:
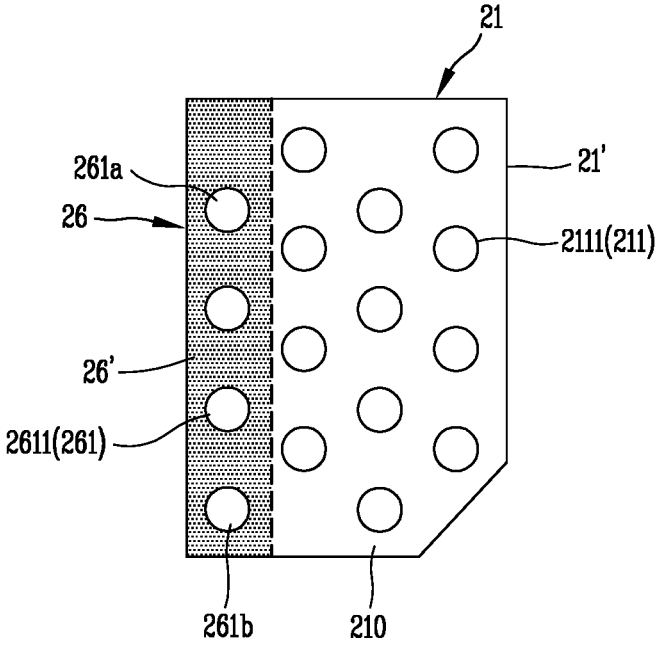
FIGS. 16 through 23 are conceptual views illustrating a configuration in which an internal heat exchanger is installed in various embodiments at a downstream side of the evaporator.

In the heat exchange expansion fin 210 in FIG. 16, the refrigerant pipe 211 of the evaporator 21 may be installed on the heat exchange expansion fin 210 in the remaining portion of the heat exchange expansion fin 210 of the evaporator 21 excluding the internal heat exchanger mounting part 26'. Four refrigerant pipes 211 of the evaporator 21 may be installed in a first through a fourth column in each of a second through a fourth row in the heat exchange expansion fin 210 of the evaporator 21.

In the evaporator 21 in FIG. 16, a ratio occupied by the internal heat exchanger 26 may be 1/4, and a ratio occupied by the refrigerant pipe 211 of the evaporator 21 may be 3/4. In the evaporator 21 illustrated in FIG. 17, the internal heat exchanger 36 is may be provided in a single row at a downstream side of the evaporator 21 with respect to the movement direction of air, but the straight pipe portions 361 of the internal heat exchange pipe 36 may be provided in a second through a fourth column (1 row by 3 columns) in a first row on a left side surface of the heat exchange expansion fin 210 of the evaporator 21. This internal heat exchange pipe may have a smaller number of straight pipe portions than the internal heat exchange pipe of FIG. 16.

Figure 17:
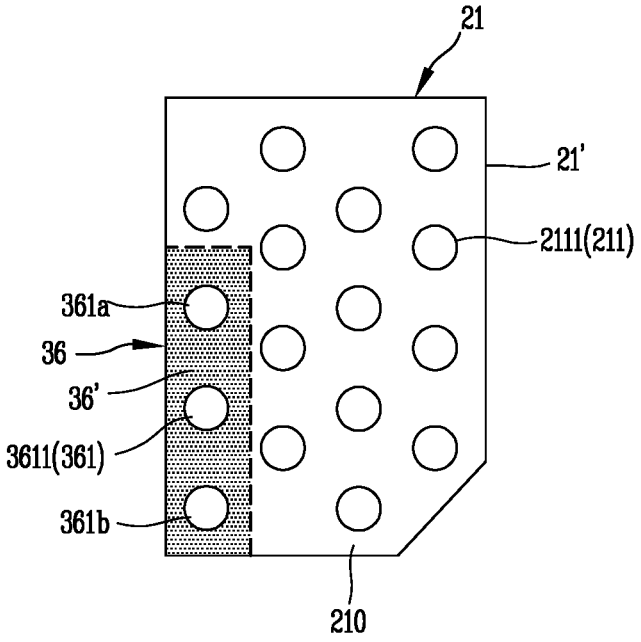

The internal heat exchange pipe 361 of FIG. 17 may be located below a part of the refrigerant pipe 211 of the evaporator 21. In other words, the straight pipe portions 3611 of the internal heat exchange pipe 361 may be located below the refrigerant pipe 211 of the evaporator 21 located in a first column of a first row in the heat exchange expansion fin 210 of the evaporator 21. When the straight pipe portions 3611 of the inner heat exchanger pipe 361 may be located below the refrigerant pipe 211 of the evaporator 21, condensate water generated from the evaporator 21 may be heated and evaporated by the internal heat exchange pipe and the heat exchanger mounting portion 36' while flowing downward, and thus may be disadvantageous from the standpoint discharging of condensate water.

Figure 18:
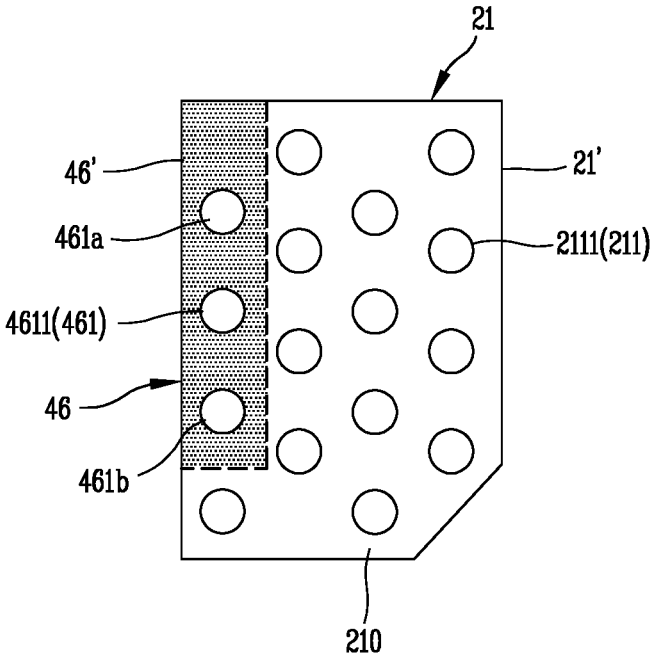

In the evaporator 21 illustrated in FIG. 18, the internal heat exchanger 46 may be provided in a first through a third column in a first row at a downstream side of the evaporator 21 with respect to the movement direction of air, and the straight pipe portions 4611 of the internal heat exchange pipe 461 may be provided in one row by three columns on a left side surface of the heat exchange expansion fin 210 of the evaporator 21. Unlike FIG. 17, the straight pipe portions 4611 of the internal heat exchange pipe 461 may be located above the refrigerant pipe 211 of the evaporator 21 (a straight portion of the evaporator 21 located in a first row and a fourth column in the heat exchange expansion fin 210 of the evaporator 21).

When the straight pipe portions 4611 of the inner heat exchange pipe 461 are located above the refrigerant pipe 211 of the evaporator 21, condensate water generated from the evaporator 21 may flow down without coming into contact with the inner heat exchanger pipe 461 and the inner heat exchanger mounting portion 46', and thus it is advantageous from the standpoint of discharging condensate water.

Figure 19:
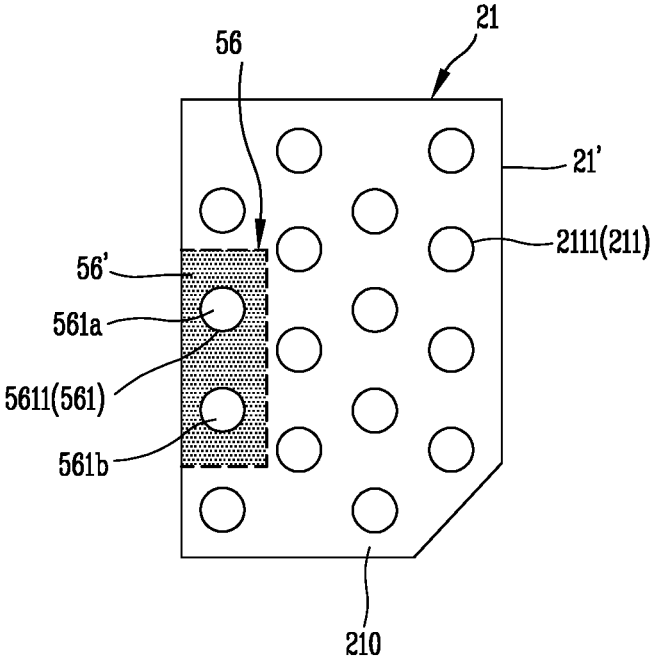

In the evaporator 21 illustrated in FIG. 19, the internal heat exchanger 56 may be provided in a row at a downstream side of the evaporator 21 with respect to the movement direction of air, and the straight pipe portion 561 of the internal heat exchange pipe 56 may be provided in a second through a third column in a first row (1 row×2 columns) at a left side surface of the heat exchange expansion fin 210 of the heat exchanger 21.

The straight pipe portions 5611 of the inner heat exchange pipe 561 may be located between a first column and a fourth column in a first row of the straight pipe portion 2111 of the refrigerant pipe 211 of the evaporator 21. The internal heat exchanger 66, 76, 86, 96 illustrated in FIGS. 20 through 23 may be provided in at least one or more columns in two rows at a downstream side of the evaporator 21 (including a first row and a second row).

Figure 20:
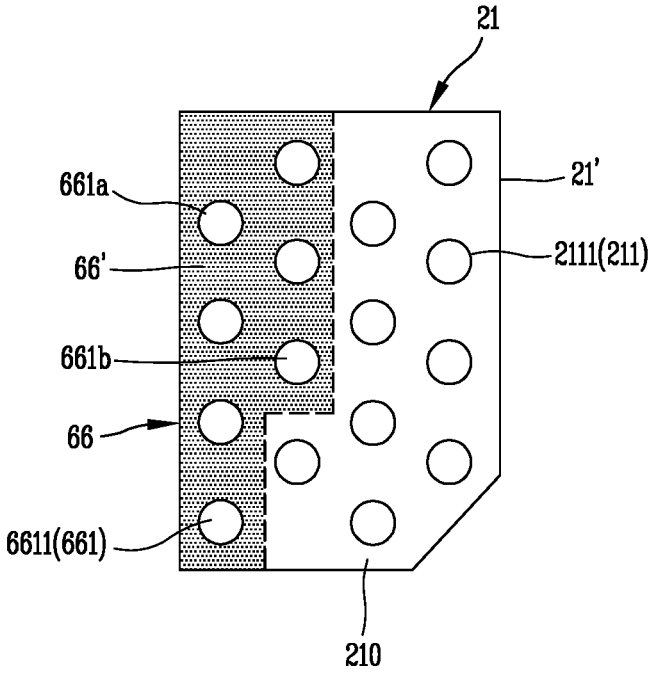

The internal heat exchanger 66 illustrated in FIG. 20 may be provided in a first row and a second row at a downstream side of the evaporator 21. A total of seven straight pipe portions 6611 of the internal heat exchange pipe 661 may be installed in a first through a fourth column in a first row and a first through a third column in a second row in the heat exchange expansion fin 210 of the evaporator 21. The straight pipe portions 6611 of the inner heat exchange pipe 661 provided in a first through a third column in the second row may be located above the straight pipe portions 2111 (located in a second row and a fourth column) of the refrigerant pipe 211 of the evaporator 21, and thus it is advantageous from the standpoint of discharging condensate water.

Figure 21:
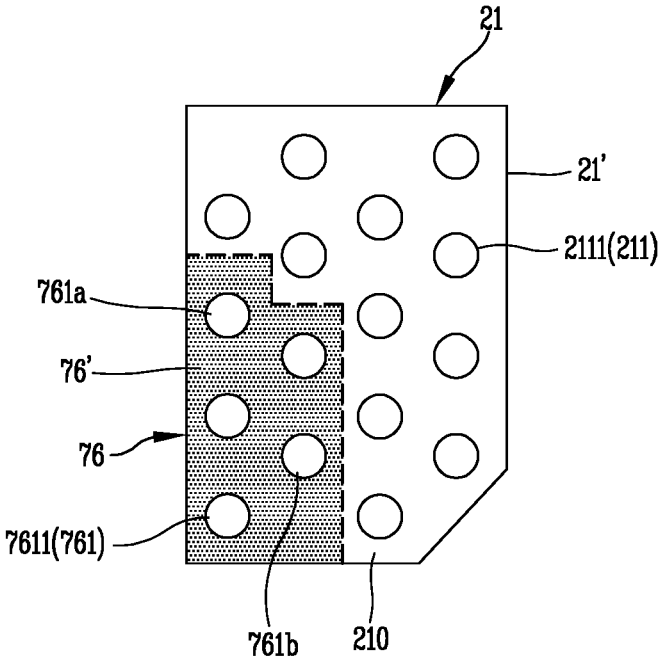

Three and two straight pipe portions of the internal heat exchanger 76 illustrated in FIG. 21 may be installed in a first and a second row, respectively, at a downstream side of the evaporator 21. The straight pipe portions 7611 of the internal heat exchange pipe 761 may be provided in a second through a fourth column, respectively, in a first row, and provided in a third and a fourth column, respectively, in a second row.

Figure 22:
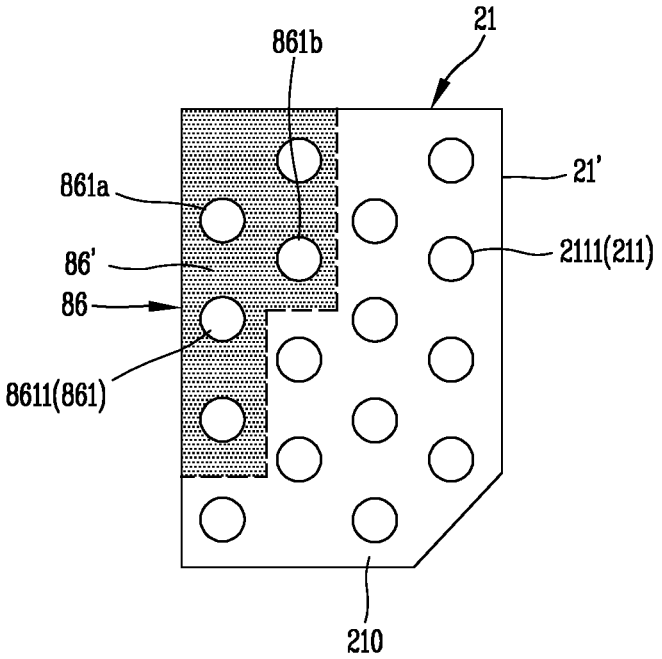

Three and two straight pipe portions of the internal heat exchanger 86 illustrated in FIG. 22 may be installed in a first and a second row, respectively, at a downstream side of the evaporator 21. The straight pipe portions 8611 of the inner heat exchange pipe 861 may be provided in a first through a third column, respectively, in a first column, and provided in a first and a second column, respectively, in a second row.

Figure 23:
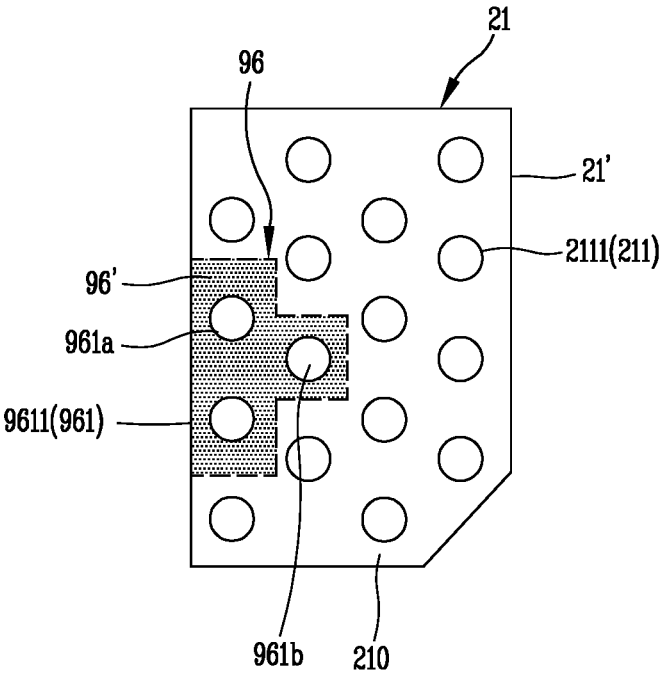

Two and one straight pipe portion(s) of the internal heat exchanger 96 illustrated in FIG. 23 may be installed in a first and a second row, respectively, at a downstream side of the evaporator 21. The straight pipe portions 9611 of the internal heat exchange pipe 961 may be provided in a second and a third column, respectively, in a first row, and installed in a third column in a second row.

As illustrated in FIGS. 16 through 23, the internal heat exchanger 26, 36, 46, 56, 66, 76, 86, 96 may be provided at a downstream side of the evaporator 21 to secure a superheat degree of the evaporator 21 and a supercooling degree of the condenser. The internal heat exchanger 46, 66, 86 may be located higher than the refrigerant pipe of the evaporator 21 within the evaporator 21 or the internal heat exchanger 26 may not be provided below the refrigerant pipe 211 of the evaporator 21 from the standpoint of discharging condensate water.

A ratio occupied by the internal heat exchanger 26, 36, 46, 56, 66, 76, 86, 96 within the evaporator 21 may be preferably in a range of 1/4 to 1/2. A ratio occupied by the internal heat exchanger 26, 36, 46, 56, 66, 76, 86, 96 may be in a range of 1/5 to 1/3 of the refrigerant pipe of the evaporator 21.

When a ratio occupied by the internal heat exchanger 26, 36, 46, 56, 66, 76, 86, 96 within the evaporator 21 is larger than an upper limit value of the above range, the dehumidifying performance of the evaporator 21 may decrease and thus cause a problem of delaying drying time. When a ratio occupied by the internal heat exchanger 26, 36, 46, 56, 66, 76, 86, 96 is smaller than a lower limit value of the above range, the dehumidifying performance of the evaporator 21 may increase but may cause difficulty in securing the superheat degree and the supercooling degree.

A number of the internal heat exchange pipes 261, 561 of the internal heat exchangers 26, 56 may be an even number (refer to FIGS. 16 and 19). When a number of each row of the internal heat exchange pipe 361*a*, 461*a*, 761*a* of the internal heat exchange pipe 361, 461, 761 (refer to FIGS. 17, 18 and 19), the inlet 361*a*, 461*a*, 761*a* and the outlet 361*b*, 461*b*, 761*b* of the internal heat exchange pipe 361, 461, 761 may be arranged in opposite directions to each other, thereby complicating the pipe structure of refrigerant and increasing the pipe length of refrigerant.

For example, when a number of the internal heat exchange pipes 361, 461, and 761 is an odd number, the refrigerant inlet 361*a*, 461*a*, 761*a* of the internal heat exchange pipe 361, 461, 761 may be provided behind the heat exchange duct portion 31. The refrigerant outlet 361*b*, 461*b*, 761*b* of the refrigerant heat exchanger pipe 361, 461, 761 may be provided in front of the heat exchange duct portion 31.

When the refrigerant outlet 361*b*, 461*b*, 761*b* of the internal heat exchange pipe 361, 461, 761 is provided in front of the heat exchange duct portion 31, the dryer 28, the expansion vale 25 and the like connected to the refrigerant outlet 361*b*, 461*b*, 761*b* of the internal heat exchange pipe 361, 461, 761 may be located behind the heat exchange duct portion 31. Thus the refrigerant pipe may protrude to an outer front side of the heat exchange duct portion from the refrigerant outlet of the internal heat exchange pipe 361, 461, 761 to bypass the heat exchange duct portion 31, and connected to the dryer 28 and the expansion valve 24, thereby complicating the structure of the refrigerant pipe and increasing the length of the refrigerant pipe.

The compressor 22 may be an inverter compressor. The inverter compressor 22 may control a frequency (Hz) of the compressor 22 to increase a refrigerant discharge amount of the compressor 22.

As the frequency of the compressor 22 rises, the refrigerant discharge amount and the refrigerant temperature of the condenser may increase. In the early stage of drying, the frequency of the compressor 22 may be maximized to increase the refrigerant temperature of the condenser as soon as possible, thereby quickly reaching a drying constant rate section through the air heating of the condenser.

Figure 24:
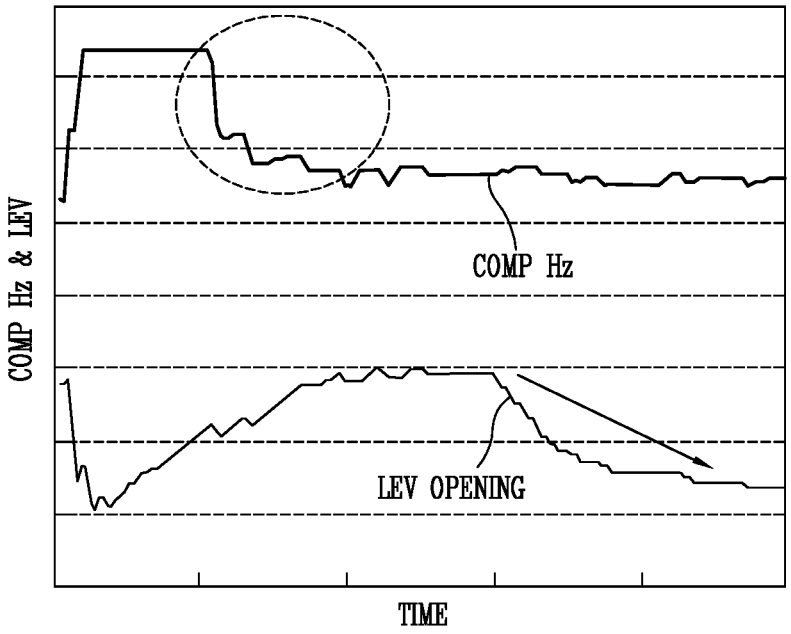
FIG. 24 RELATED ART
FIG. 24 is a graph illustrating changes in frequency (Hz) of the compressor and opening degree of the expansion valve (LEV) according to an elapsed drying time in a heat pump washer dryer in the related art.

As shown by a circle in FIG. 24, according to the related art, it is required to control the compressor to reduce a frequency of the compressor due to premature superheating of the condenser in the early stage of drying.

However, refrigerant discharged from the condenser 23 may exchange heat with the refrigerant of the evaporator 21 through the internal heat exchanger 26 to supercool the refrigerant of the condenser 21 even without an auxiliary condenser that has been provided for the supercooling of the condenser in the related art, thereby securing the degree of undercooling. As shown by a circle in FIG. 25, a control point of the compressor 22 may be delayed by the supercooling of the condenser 23 through the internal heat exchanger 26. In other words, the frequency of the compressor 22 may be further maintained for a predetermined time without reducing the frequency of the compressor 22 at an early stage to increase the work of the compressor 22, thereby obtaining an effect of reducing drying time.

In FIG. 24 again, as an arrow is inclined downward in the direction in which an opening degree of the expansion valve gradually decreases toward the latter half of drying, according to the related art, it is required to reduce the opening degree of the expansion valve to secure the degree of superheat of the evaporator and protect the compressor. However, refrigerant discharged from the condenser 23 may be provided at a downstream side of the evaporator 21 through the internal heat exchanger 26 to perform heat exchange between the refrigerant of the evaporator 21 and the refrigerant of the condenser 23 at a later stage of the evaporator 21, thereby achieving the superheat of refrigerant at a later stage of the evaporator 21 to secure the degree of superheat. Accordingly, referring to FIG. 25, an opening degree of the expansion valve 24 may be increased and maintained toward the latter half of drying to increase and maintain a flow rate of the refrigerant supplied to the evaporator 21, thereby protecting the compressor while increasing the work of the compressor 22.

Figure 25:
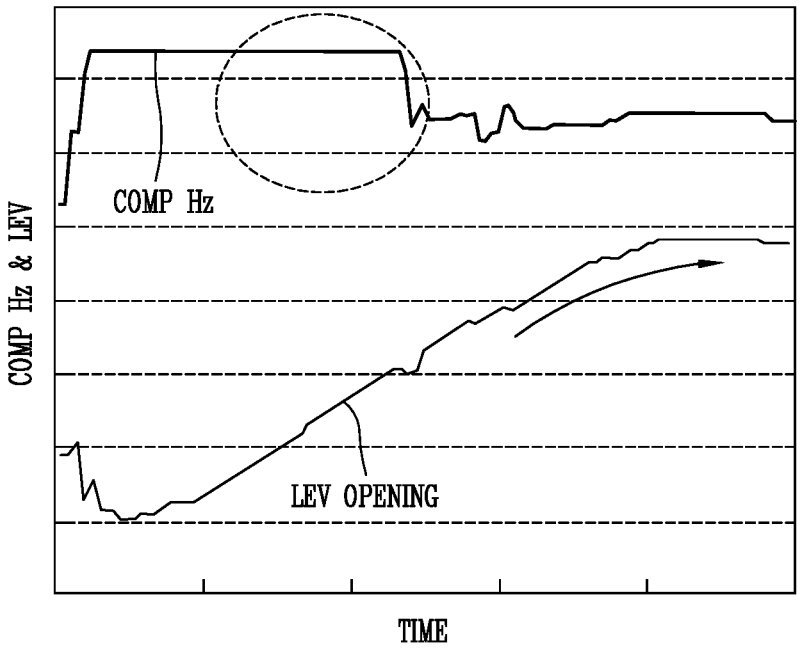
FIG. 25 is a graph illustrating changes in frequency (Hz) of the compressor and opening degree of the expansion valve (LEV) according to an elapsed drying time in a heat pump washer dryer of an embodiment.

Comparing FIG. 24 with FIG. 25, though an opening degree of the expansion valve decreases toward the latter half of drying in case of FIG. 24 (related art), the opening degree of the expansion valve 24 may be increased and maintained in case of FIG. 25. The control direction of the expansion valve 24 according to the present disclosure is opposite to that of the related art.

Figure 26:
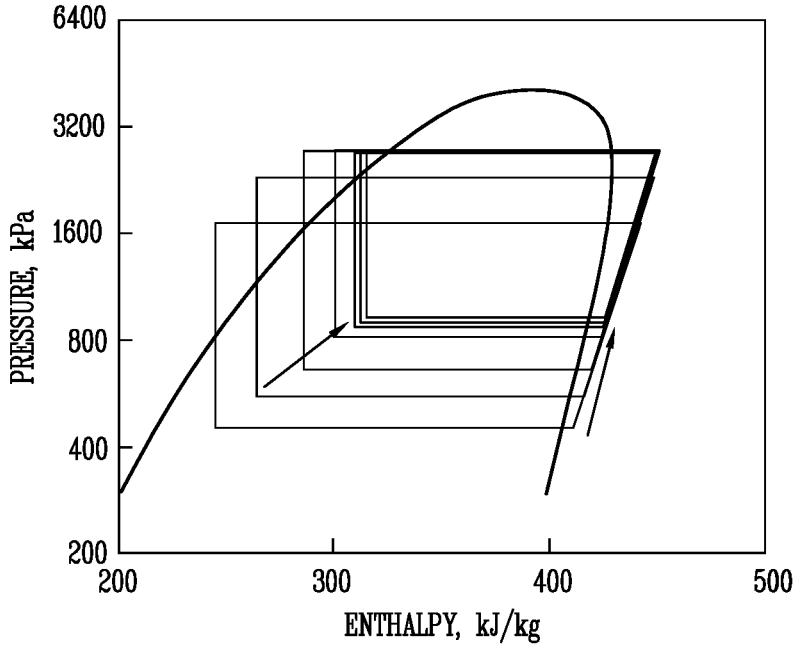
FIG. 26 RELATED ART
FIG. 26 is a graph illustrating a pressure and enthalpy change of each process of the heat pump cycle according to an elapsed drying time in a p (pressure)—h (enthalpy) diagram according to the related art.
Figure 27:
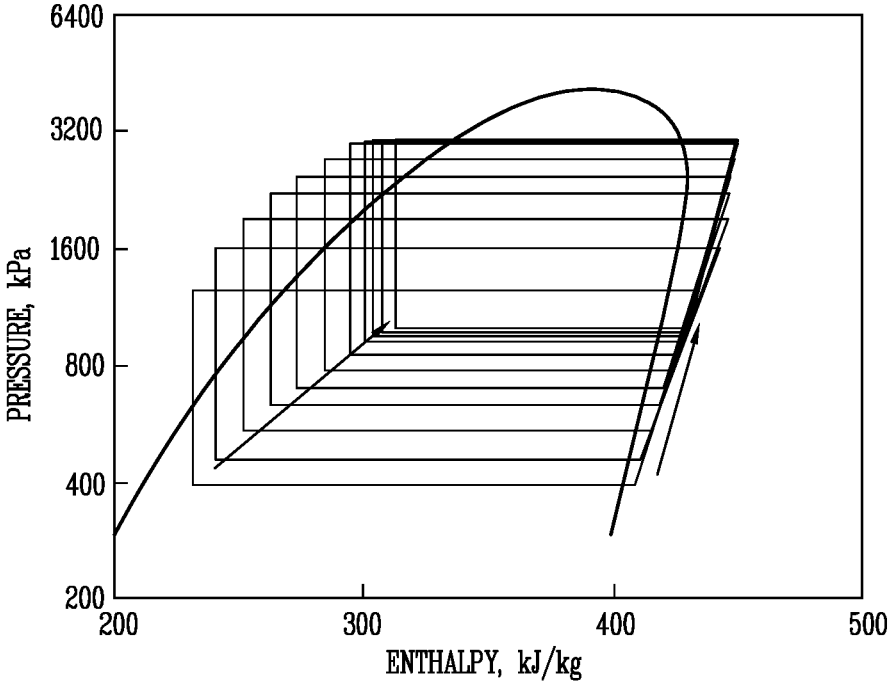
FIG. 27 is a graph illustrating a pressure and enthalpy change of each process of the heat pump cycle according to an elapsed drying time in a p-h diagram according to an embodiment.

Comparing pressure and enthalpy changes in the process of evaporation, compression, condensation and expansion of a heat pump cycle according to the related art and the present disclosure on p-h diagrams in FIGS. 26 and 27, a heat pump cycle to which the internal heat exchanger 26 is applied may suppress the refrigerant of the evaporator 21 from overheating more than necessary. In addition, a preset degree of supercooling of the condenser 23 may be secured.

Figure 28:
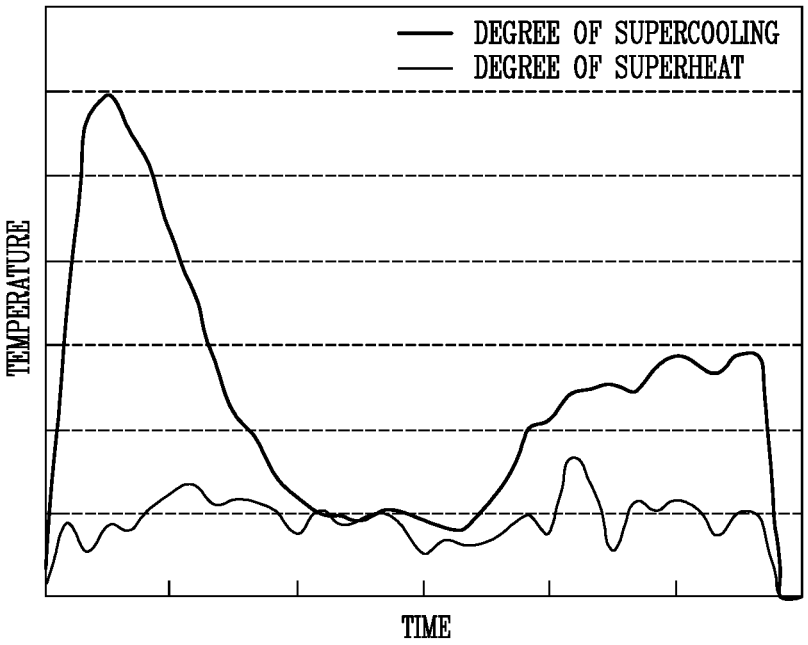
FIG. 28 RELATED ART
FIG. 28 is a graph illustrating changes in supercooling degree and superheat degree according to an elapsed drying time of the related art.
Figure 29:
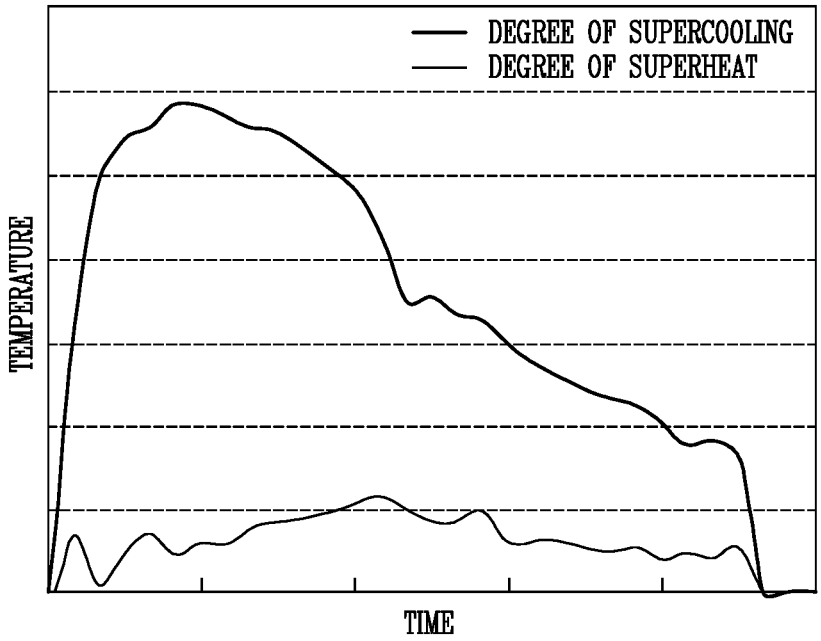
FIG. 29 is a graph illustrating changes in supercooling degree and superheat degree according to an elapsed drying time of an embodiment.

Comparing changes in a degree of supercooling of the condenser 23 and a degree of superheat of the evaporator according to FIG. 28 of the related art and FIG. 29, the degree of superheat may be secured even up to an early stage or middle stage of drying by applying the internal heat exchanger 26, Furthermore, it is seen that the degree of superheat may be controlled within an appropriate range.

A clothes treatment apparatus may include a drum rotatably provided within a cabinet to accommodate washing and drying objects; and a heat pump module provided with an evaporator, a compressor, a condenser, and an expansion valve, through which refrigerant is circulated, to provide a heat source to air discharged from the drum and circulated to the drum, wherein the heat pump module includes an internal heat exchanger configured to exchange heat between refrigerant discharged from the condenser and refrigerant passing through the evaporator. The internal heat exchanger may be configured with a fin-and-pipe type heat exchanger.

The internal heat exchanger may be provided within the evaporator. The internal heat exchanger may include an internal heat exchange pipe disposed within the evaporator; and a connection pipe connecting a refrigerant outlet of the condenser to the internal heat exchange pipe to introduce refrigerant discharged from the condenser into the internal heat exchange pipe.

The internal heat exchanger may be disposed at a downstream side of the evaporator with respect to a movement direction of the air. The internal heat exchanger may share a heat exchange fin of the evaporator to exchange heat between refrigerant discharged from the condenser through the heat exchange fin and refrigerant of the evaporator.

A refrigerant outlet of the evaporator may be provided at a downstream side of the evaporator, and the internal heat exchanger may exchange heat between refrigerant discharged from the condenser and refrigerant at an outlet side of the evaporator. The internal heat exchange pipe may include a plurality of straight pipe portions spaced in an up-down direction at a downstream side with respect to the movement direction of the air in the heat exchange fin of the evaporator; and a plurality of connection pipe portions arranged in a protruding manner from the heat exchange fin of the evaporator to connect end portions of two straight pipe portions adjacent to each other among the plurality of straight pipe portions.

The plurality of straight pipe portions may be provided at the last row at a downstream side of the evaporator with respect to the movement direction of the air. The plurality of straight pipe portions may be provided in a first part of the last row of the evaporator, and a refrigerant pipe of the evaporator may be disposed in a second part of the last row of the evaporator. The plurality of straight pipe portions may be further provided in a part of rows at an upstream side from the last row of the evaporator. The plurality of straight pipe portions may be provided higher than the refrigerant pipe of the evaporator.

The internal heat exchanger pipe may be arranged at a ratio of 1/5 to 1/3 of the refrigerant pipe of the evaporator.

The plurality of straight pipe portions map be provided adjacent to a refrigerant outlet of the evaporator. The plurality of straight pipe portions may be provided adjacent to a refrigerant inlet of the evaporator.

A clothes treatment apparatus may include a tub provided within a cabinet to store wash water; a drum rotatably provided within the tub to accommodate washing and drying objects; and a heat pump module provided with an evaporator, a compressor, a condenser, and an expansion valve, through which refrigerant is circulated, to provide a heat source to air discharged from the drum and circulated to the drum, wherein the heat pump module includes a heat exchange duct portion configured to accommodate the evaporator and the condenser and connected to the tub to form a flow path for circulating the air; and an internal heat exchanger provided with an internal heat exchange pipe extended from the condenser to an inside of the evaporator to exchange heat between the internal heat exchange pipe and a refrigerant pipe of the evaporator within the evaporator.

The internal heat exchanger may include a connection pipe connecting a refrigerant outlet pipe of the condenser and the internal heat exchange pipe to introduce refrigerant discharged from the condenser into the internal heat exchange pipe, wherein the internal heat exchange pipe is provided within the evaporator. The heat pump module may include a suction fan provided at one side of the heat exchange duct portion to introduce air discharged from the drum into the drum through the evaporator and the condenser so as to circulate the air.

The heat exchange duct portion may be provided at an upper portion and a front side of the tub, and the evaporator and the condenser may be eccentrically formed in one lateral direction from a center line in an up-down direction of the tub and spaced apart from each other in the lateral direction. A lower side of the condenser may extend in a downward direction lower than the evaporator.

An air inlet side of the heat exchange duct portion may be communicably connected to an upper left rear side of the tub, and an air outlet side thereof may be communicably connected to an upper right front side of the tub, and a movement direction of the air may be directed from a left rear side of the tub to a right front side thereof. The condenser may be provided at a downstream side of the evaporator with respect to the movement direction of the air, and the refrigerant of the condenser may flow in a direction opposite to the movement direction of the air.

The internal heat exchange pipe may be provided in one row or two rows at a downstream side of the evaporator with respect to the movement direction of the air, and a refrigerant outlet of the evaporator may be provided at a downstream side of the evaporator to transfer heat emitted from the condenser to a refrigerant outlet of the evaporator. The internal heat exchange pipe may be provided in one row or two rows at a downstream side of the evaporator with respect to the movement direction of the air, and a refrigerant inlet of the evaporator may be provided at a downstream side of the evaporator to transfer heat emitted from the condenser to a refrigerant inlet of the evaporator.

A clothes treatment apparatus may include a tub provided within a cabinet to store wash water; a drum rotatably provided within the tub to accommodate washing and drying objects; and a heat pump module provided with an evaporator, a gas-liquid separator, a compressor, a condenser, and an expansion valve, through which refrigerant is circulated, to provide a heat source to air discharged from the drum and circulated to the drum, wherein the heat pump module includes a heat exchange duct portion configured to accommodate the evaporator and the condenser and connected to the tub to form a flow path for circulating the air; a compressor base portion integrally connected to a rear portion of the heat exchange duct portion to support the compressor; a gas-liquid separator mounting portion integrally provided with a rear portion of the heat exchange duct portion and one lateral portion of the compressor base portion to support the gas-liquid separator; and an internal heat exchanger provided with an internal heat exchange pipe extended from the condenser to an inside of the evaporator to exchange heat between the internal heat exchange pipe and a refrigerant pipe of the evaporator within the evaporator.

The heat exchange duct portion may partially cover an upper front portion of the tub, and the compressor base portion may cover a part of an upper rear portion of the tub, and the gas-liquid separator mounting portion may cover another part of the upper rear portion of the tub, and a front portion of the heat exchange duct portion may be fastened to a front surface of the cabinet, and a rear portion of the compressor base portion may be fastened to a rear surface of the cabinet. A part of the heat exchange duct portion in which the evaporator and the condenser are accommodated, the compressor base portion on which the compressor is mounted, and the gas-liquid separator mounting portion may be eccentrically arranged in one lateral direction from a central line in a front-rear direction of the tub to cover an upper one side of the tub.

An air inlet portion of the heat exchange duct portion may be communicably connected to an upper left rear portion of the tub, and an air outlet portion thereof may be communicably connected to an upper right front portion of the tub.

An outlet portion of the heat exchange duct portion may be communicably connected to a gasket provided in front of the tub. The internal heat exchanger pipe may include an internal heat exchange pipe arranged in one row or two rows at a downstream side of the evaporator with respect to the movement direction of the air, and a refrigerant inlet of the evaporator may be provided at an upstream side of the evaporator, and a refrigerant outlet of the evaporator may be provided at a downstream side of the evaporator, and a first refrigerant pipe extended from the expansion valve to the refrigerant inlet of the evaporator and a second refrigerant pipe extended from the refrigerant outlet of the evaporator to the gas-liquid separator may intersect with each other.

The internal heat exchanger pipe may include an internal heat exchange pipe arranged in one row or two rows at a downstream side of the evaporator with respect to the movement direction of the air, and a refrigerant outlet of the evaporator may be provided at an upstream side of the evaporator, and a refrigerant inlet of the evaporator may be provided at a downstream side of the evaporator, and a first refrigerant pipe extended from the expansion valve to the refrigerant inlet of the evaporator and a second refrigerant pipe extended from the refrigerant outlet of the evaporator to the gas-liquid separator may be parallel to each other.

A clothes treatment apparatus may include a tub provided within a cabinet to store wash water; a drum rotatably provided within the tub to accommodate washing and drying objects; and a heat pump module provided with an evaporator, a gas-liquid separator, a compressor, a condenser, and an expansion valve, through which refrigerant is circulated, to provide a heat source to air discharged from the drum and circulated to the drum, wherein the heat pump module includes a compressor base portion configured to support the compressor; and an internal heat exchanger provided with an internal heat exchange pipe extended from the condenser to an inside of the evaporator to exchange heat between the internal heat exchange pipe and a refrigerant pipe of the evaporator within the evaporator. The compressor may be a horizontal compressor in which a rotating shaft is disposed in a front-rear direction of the cabinet.

The compressor may include a bracket in which a central portion thereof is fixed to surround a part of an upper outer circumferential surface of a compressor body, and an edge portion thereof is provided at an upper portion of the compressor base portion and fastened to the compressor base portion to support the compressor body while hanging the compressor main body at an upper portion of the compressor base portion; and an anti-vibration mount provided between an edge portion of the bracket and an upper portion of the compressor base portion to elastically support the bracket. A refrigerant outlet of the compressor may be provided in a direction of facing a refrigerant inlet pipe of the condenser.

According to the foregoing embodiments, an internal heat exchanger extended from the condenser to an inside of the evaporator may be provided therein, thereby obtaining an effect of expanding a heat exchange area of the condenser. An additional installation space of the condenser for expanding the condenser may not be separately provided within the clothes treatment apparatus, thereby enhancing the utilization of an upper space of the cabinet in which the heat pump system is mounted.

As a heat exchanging area of the condenser increases, it may be possible to obtain efficient heating of the condenser, thereby further increasing the work of the compressor. As heat exchange is carried out between the condenser and the evaporator through the internal heat exchanger, the condenser may be cooled using a low temperature portion of the evaporator, thereby further securing a degree of supercooling of the condenser.

Unlike the related art in which the heat of the condenser is dissipated using the auxiliary condenser, the heat of the condenser may not be discharged to the outside, thereby having an advantage in which there is no loss in the aspect of energy. Heat to be dissipated from the condenser to the outside may be recycled to heat the evaporator, thereby securing an adequate degree of superheat of the evaporator.

When a degree of superheat of the evaporator is insufficient, unlike the related art in which the degree of superheat is secured by reducing an opening degree of the expansion valve to reduce a flow rate of refrigerant flowing into the evaporator, it may be possible to stably secure the degree of superheat even when the opening degree of the expansion valve is enlarged or maintained without reducing a circulation amount of refrigerant in the later stage of the drying cycle through the internal heat exchanger. A normal operating range of the heat pump cycle may be widely secured through heat exchange between the evaporator and the condenser, thereby enhancing the capacity and capability of the heat pump cycle.

Unlike the related art in which a frequency of the compressor is reduced due to premature superheat at the start of the drying cycle, the work of the compressor may be increased as the control point of reducing the frequency (Hz) of the compressor is delayed due to an expansion effect of the condenser, thereby reducing drying time.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treatment apparatus, comprising:

a tub provided within a cabinet to store wash water;

a drum rotatably provided within the tub to accommodate washing and drying objects; and a heat pump including an evaporator, a gas-liquid separator, a compressor, a condenser, and an expansion valve, through which refrigerant is circulated to provide heat to air circulated through the drum, wherein the heat pump further includes:

a heat exchange duct configured to accommodate the evaporator and the condenser and connected to the tub to form a flow path to circulate the air;

a compressor base integrally connected to a rear portion of the heat exchange duct to support the compressor;

a gas-liquid separator mount integrally formed with a rear portion of the heat exchange duct and one lateral portion of the compressor base to support the gas-liquid separator; and an internal heat exchanger provided within the evaporator and including an internal heat exchange pipe extending from the condenser to an inside of the evaporator to exchange heat between the internal heat exchange pipe and a refrigerant pipe of the evaporator within the evaporator.

2. The clothes treatment apparatus of claim 1, wherein the heat exchange duct partially covers an upper front portion of the tub, the compressor base covers a first part of an upper rear portion of the tub, the gas-liquid separator mount covers a second part of the upper rear portion of the tub, a front portion of the heat exchange duct is fastened to a front surface of the cabinet, and a rear portion of the compressor base is fastened to a rear surface of the cabinet.

3. The clothes treatment apparatus of claim 2, wherein an air inlet of the heat exchange duct is communicably connected to an upper left rear portion of the tub, and an air outlet of the heat exchange duct is communicably connected to an upper right front portion of the tub.

4. The clothes treatment apparatus of claim 3, wherein an outlet of the heat exchange duct is communicably connected to a gasket provided in front of the tub.

5. The clothes treatment apparatus of claim 3, wherein the internal heat exchanger pipe includes an internal heat exchange pipe arranged in one row or two rows at a downstream side of the evaporator with respect to the movement direction of the air, a refrigerant inlet of the evaporator is provided at an upstream side of the evaporator, a refrigerant outlet of the evaporator is provided at a downstream side of the evaporator, and a first refrigerant pipe extending from the expansion valve to the refrigerant inlet of the evaporator and a second refrigerant pipe extending from the refrigerant outlet of the evaporator to the gas-liquid separator intersect with each other.

6. The clothes treatment apparatus of claim 3, wherein the internal heat exchanger pipe includes an internal heat exchange pipe arranged in one row or two rows at a downstream side of the evaporator with respect to the movement direction of the air, a refrigerant outlet of the evaporator is provided at an upstream side of the evaporator, a refrigerant inlet of the evaporator is provided at a downstream side of the evaporator, and a first refrigerant pipe extended from the expansion valve to the refrigerant inlet of the evaporator and a second refrigerant pipe extended from the refrigerant outlet of the evaporator to the gas-liquid separator are parallel to each other.

7. The clothes treatment apparatus of claim 1, wherein a part of the heat exchange duct in which the evaporator and the condenser are accommodated, the compressor base on which the compressor is mounted, and the gas-liquid separator mount are sequentially arranged in a lateral direction from a central line in an axial direction of the tub to cover a first upper side of the tub.

8. A clothes treatment apparatus, comprising:

a tub provided within a cabinet to store wash water;

a drum rotatably provided within the tub to accommodate washing and drying objects; and a heat pump including an evaporator, a gas-liquid separator, a compressor, a condenser, and an expansion valve, through which refrigerant is circulated, to provide heat to air discharged from the drum and circulated to the drum, wherein the heat pump further includes:

a compressor base configured to support the compressor; and an internal heat exchanger provided within the evaporator, the internal heat exchanger including an internal heat exchange pipe extending from the condenser to an inside of the evaporator to exchange heat between the internal heat exchange pipe and a refrigerant pipe of the evaporator within the evaporator.

9. The clothes treatment apparatus of claim 8, wherein the compressor is a horizontal compressor in which a rotating shaft is provided in an axial direction of the tub.

10. The clothes treatment apparatus of claim 9, wherein the compressor includes:

a bracket having a central portion surround a part of an upper outer circumferential surface of a compressor body, and an edge portion arranged at an upper portion of the compressor base and fastened to the compressor base to support the compressor body while hanging the compressor body at an upper portion of the compressor base; and an anti-vibration mount provided between the edge portion of the bracket and the upper portion of the compressor base to elastically support the bracket.

11. The clothes treatment apparatus of claim 9, wherein a refrigerant outlet of the compressor faces a refrigerant inlet pipe of the condenser.

* * * * *